US008249486B2

(12) United States Patent
Onodera et al.

(10) Patent No.: US 8,249,486 B2
(45) Date of Patent: Aug. 21, 2012

(54) FIXING UNIT, ROLLER REPLACEMENT AUXILIARY TOOL OF FIXING UNIT, AND IMAGE FORMING APPARATUS

(75) Inventors: Ken Onodera, Ibaraki (JP); Sho Sawahata, Ibaraki (JP); Genichiro Kawamichi, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 225 days.

(21) Appl. No.: 12/649,940

(22) Filed: Dec. 30, 2009

(65) Prior Publication Data

US 2010/0172671 A1 Jul. 8, 2010

(30) Foreign Application Priority Data

Jan. 8, 2009 (JP) ..... 2009-002811
Mar. 31, 2009 (JP) ..... 2009-086308
Sep. 2, 2009 (JP) ..... 2009-202663

(51) Int. Cl.
*G03G 15/20* (2006.01)

(52) U.S. Cl. ..... 399/122; 399/328

(58) Field of Classification Search ..... 399/122, 399/109, 320, 328; 219/216
See application file for complete search history.

(56) References Cited

U.S. PATENT DOCUMENTS

| | | | | |
|---|---|---|---|---|
| 5,301,000 | A | 4/1994 | Heigl | 399/122 |
| 6,442,360 | B1 * | 8/2002 | Onodera et al. | 399/122 |
| 7,082,273 | B2 * | 7/2006 | Matsunai | 399/328 X |
| 7,813,690 | B2 * | 10/2010 | Ichikawa et al. | 399/350 |

FOREIGN PATENT DOCUMENTS

| | | |
|---|---|---|
| EP | 0 213 745 A1 | 3/1987 |
| JP | 3-266871 | 11/1991 |
| JP | 5-504633 | 7/1993 |
| JP | 6-11984 | 1/1994 |
| JP | 10-91052 | 4/1998 |
| JP | 2003-241615 | 8/2003 |
| JP | 2008-268532 | 11/2008 |
| WO | WO 91/09351 | 6/1991 |

* cited by examiner

*Primary Examiner* — Sophia S Chen
(74) *Attorney, Agent, or Firm* — Oblon, Spivak, McClelland, Maier & Neustadt, L.L.P.

(57) ABSTRACT

Disclosed is a fixing unit that includes a heating roller; a pressure roller capable of being brought into press-contact with the heating roller, one of the heating roller and the pressure roller being capable of being extracted along a shaft direction of the roller; and an assist-unit linkage part to which an assist unit for assisting an extraction of the roller is detachably linked and which is provided at a tip end part in an extracting direction of the roller.

21 Claims, 25 Drawing Sheets

FIXING UNIT, ROLLER REPLACEMENT AUXILIARY TOOL OF FIXING UNIT, AND IMAGE FORMING APPARATUS

BACKGROUND OF THE INVENTION

1. Field of the Invention

The present invention relates to an image forming apparatus such as a laser beam printer and, in particular, to a fixing unit of the image forming apparatus, a roller replacement auxiliary tool of the fixing unit, and a roller replacement method.

2. Description of the Related Art

A known fixing unit of an image forming apparatus such as a laser beam printer and a copier fixes a toner image on a recording medium by heating and pressing the recording medium maintaining the toner image on its front surface while conveying the same so as to be held between a heating roller and a pressure roller.

Inside the heating roller, plural lamps are provided as heat sources. Generally, image forming apparatuses whose print speed is fast and that are adapted to store high ream weight recording media require high heat capacity for fixing a toner image and thus have to maintain the heating roller at a certain temperature or higher, which in turn requires a higher fixing temperature.

When a maintenance technician replaces the heating roller because the heating roller maintained at high temperature comes to the end of its service life, he or she stops the operations of the image forming apparatus, extracts the heating roller from the fixing unit after causing the heating roller itself to be cooled to a certain level enough to perform a replacement operation, and replaces the heating roller with a new one. In this case, however, it takes time to cool the heating roller and greatly reduces an operating efficiency. In addition, this causes not only the degradation of the operating efficiency because the image forming apparatus is stopped for a long time, but also a large cost for replacement maintenance operations.

Recently, there has been demanded for the image forming apparatuses adapted to high print speed, high image quality, and various sheets. Furthermore, it has been requested that the fixing unit use some types of heating rollers such as one that has a thin PFA resin or the like coated on its front surface for the purpose of promptly supplying heat required for fixing a toner image when high print speed is demanded, one that has a silicon rubber or the like coated on its front surface for the purpose of minimizing the damage and bleeding of a toner image at fixation when high image quality is demanded, and one that has a PFA resin or the like coated on a silicon rubber layer when image quality having a certain degree and roller durability are demanded.

In order to respond to such a demand in the image forming apparatus, the heating roller must be changed correspondingly. Although there is some difference depending on the types, the heating roller has basically a high heat capacity and takes a long time to cool so as to be replaceable from a high temperature state at which the heating roller is maintained to supply the heat required for optimum toner fixation. The replacement of the heating roller is discussed in, for example, Patent Document 1 (Japanese Patent Application National Laid-Open Publication No. 5-504633).

FIGS. 1 and 2 are a partial cross-sectional view of the fixing unit described in Patent Document 1 and a perspective view of the fixing unit showing the heating roller being replaced.

FIG. 1 is the partial cross-sectional view of the fixing unit described in Patent Document 1. As shown in FIG. 1, one end of the heating roller 100 is supported by a frame 102 through a support flange 101. The support flange 101 has a bearing 103, and the bearing 103 is fitted in the opening end of the heating roller 100 together with a centering member 104. Although not shown in FIG. 1, the other end of the heating roller 100 is also supported by a support flange through a bearing.

The support flange 101 is fixed to the frame 102 through a wing screw 106. The support flange 101 is fixed to a holding claw 108 through a wing screw 107, and the holding claw 108 is used for setting the position of the heating roller 100 when the heating roller 100 is replaced.

Inside the heating roller 100, plural radiator modules 105 are arranged. First ends of the plural radiator modules 105 are held at the center of the support flange 101 through the holding member 109. Although not shown in FIG. 1, the other ends of the plural radiator modules 105 are also indirectly supported by the support flange through a holding member.

As shown in FIG. 1, a connector 110 provided at the ends of the plural radiator modules 105 is projected outward more than the support flange 101 where the plural radiator modules 105 are held at the center of the support flange 101. The support flange 101 is integrally provided with a grip 111 for replacing the heating roller 100. The grip 111 is provided so as to straddle the connector 110 of the plural radiator modules 105 projected from the support flange 101.

As shown in FIG. 2, when the heating roller 100 is replaced, an operator unfastens the wing screw 106 and extracts the heating roller 100 from the frame 102 together with the support flange 101 or the like by holding the grip 111 with one hand.

Generally, the heating roller for use in the fixing unit of this type is a cylinder having a diameter of about 100 mm and a length of 500 mm or larger, which is very heavy in weight. Under such a circumstance, when an operator extracts the heating roller 100 from the frame 102 together with the support flange 101 or the like by holding the grip 111 with one hand, an extracting operation is likely to be unstable due to the weight and heat of the heating roller 100 or the like. Therefore, during the replacement of the heating roller 100, there is a likelihood of causing the heating roller 100 to be brought into contact with other components such as the frame 102 to damage the front surface of the heating roller 100.

As described above, since the posture of the heating roller 100 becomes unstable and no auxiliary tool is provided for stabilizing the posture of the heating roller 100, an operator puts one hand on the heating roller 100 when replacing the heating roller 100 in an embodiment disclosed in Patent Document 1. However, when an operator touches the heating roller 100 at high temperature, he or she gets burned or gets soiled by a toner releasing agent and lubricant oil attached on the heating roller 100, which results in problems in operations.

In addition, since the grip 111 is integrated with the support flange 101 holding the plural radiator modules 105 and arranged near the ends of the plural radiator modules 105, the grip 111 itself is also at high temperature. Therefore, it is difficult for an operator to hold the grip 111 when replacing the heating roller 100.

Also, the grip 111 is used for rotating and holding the heating roller 100 when the image forming apparatus is in an operating state, and it is screwed to a link member (not shown). Therefore, the link member and screws are also at high temperature. For this reason, the separation of the heating roller 100 from the link member is an operation for handling members including the screws at high temperature, which results in problems in workability and safety.

Moreover, the grip 111 is provided at the center of the support flange 101, which in turn interferes with the replacement of the plural radiator modules 105. Therefore, the plural radiator modules 105 are restricted to be inserted in and extracted from the other support flange where the grip 111 is not provided, which results in problems in operations.

Furthermore, the grip 111 projects from the support flange 101. Therefore, space is wasted, which results in problems in the miniaturization of the image forming apparatus.

Furthermore, when an operator extracts the heating roller 100 from the frame 102 together with the support flange 101 or the like by holding the grip 111 with one hand, there is a likelihood of causing the heating roller 100 to be brought into contact with the frame 102 to damage the front surface of the roller. Therefore, the vicinity of the opening of the frame 102 is coated with felt 130 so as to be protected. However, when the heating roller 100 having a releasing agent and lubricant oil attached on its front surface is slid, a stain accumulates on the felt 130. Therefore, the above configuration is insufficient for protecting the front surface of the heating roller 100.

Furthermore, the felt 130 is required to be attached and separated every time the heating roller 100 is replaced, which results in complicated replacement operations. Moreover, the felt 130 is stained every time the heating roller 100 is replaced, which in turn requires the disposal of the stained felt 130 and the preparation of new felt 130.

Patent Document 1: Japanese Patent Application National Laid-Open Publication No. 5-504633

Patent Document 2: Japanese Laid-open Patent Publication No. 6-011984

SUMMARY OF THE INVENTION

The present invention has been made in view of the above drawbacks and may provide a fixing unit that can be miniaturized, a roller that can be replaced, a roller replacement auxiliary tool, a roller replacement method, and an image forming apparatus.

According to a first aspect of the present invention, there is provided a fixing unit that includes a heating roller; a pressure roller capable of being brought into press-contact with the heating roller, one of the heating roller and the pressure roller being capable of being extracted along a shaft direction of the roller; and an assist-unit linkage part to which an assist unit for assisting an extraction of the roller is detachably linked and which is provided at a tip end part in an extracting direction of the roller.

According to a second aspect of the present invention, there is provided a fixing unit that includes a heating roller; a pressure roller capable of being brought into press-contact with the heating roller, one of the heating roller and the pressure roller being capable of being inserted and extracted along a shaft direction of the roller; an opening for replacement formed in a frame opposite to the roller capable of being inserted and extracted; and a support member provided outside the frame and near the opening for replacement so as to support the roller to be extracted and inserted.

According to a third aspect of the present invention, there is provided an image forming apparatus that includes a transfer unit that transfers a toner image on an image carrier onto a medium; and the fixing unit described above; wherein the fixing unit has the heating roller and the pressure roller capable of being brought into press-contact with the heating roller, and causes the medium having the toner image transferred thereon to pass through a gap between the heating roller and the pressure roller to fix the toner image onto the medium.

According to a fourth aspect of the present invention, there is provided a roller replacement auxiliary tool of a fixing unit that extracts and replaces one of a heating roller and a pressure roller capable of being brought into press-contact with the heating roller along a shaft direction of the roller. The roller replacement auxiliary tool includes a guide shaft detachably attached to the fixing unit so as to penetrate an opening formed by penetration in the shaft direction of the roller to be replaced; and an assist unit that is detachably attached to an assist-unit linkage part provided at a tip end part in an extracting direction of the roller to be replaced and is externally fit in an end part of the guide shaft to insert and extract the roller.

Other objects, features and advantages of the present invention will become more apparent from the following detailed description when read in conjunction with the accompanying drawings.

BRIEF DESCRIPTION OF THE DRAWINGS

FIGS. 9A and 9B are cross-sectional views of the assist unit, wherein FIG. 9A is a view where lever parts of two latches are mutually directed outward, and FIG. 9B is a view showing where the lever parts are mutually directed inward;

FIGS. 12A and 12B are cross-sectional views showing a relationship between an absorber and holding pieces of a holder taken along the plane X-X in FIG. 7, wherein FIG. 12A is a view where the assist unit is inserted in the heating roller, and FIG. 12B is a view where the assist unit is attached to the absorber;

FIGS. 17A and 17B are views showing the relationship between the absorber and the holding pieces of the holder taken along the place Y-Y in FIG. 15, wherein FIG. 17A is a view where the assist unit is inserted in the heating roller, and FIG. 17B is a view where the assist unit is attached to the absorber;

FIGS. 18A and 18B are cross-sectional views of the assist unit according to the second embodiment of the present invention, wherein FIG. 18A is a view where the lever parts of the two latches are mutually directed outward, and FIG. 18B is a view where the lever parts are mutually directed inward;

FIGS. 20A through 20F are views showing a support roller member, wherein FIGS. 20A and 20B are a side view and a plan view when the support roller member is at an operating position, FIGS. 20C and 20D are a side view and a plan view when the support roller member is being moved from the operating position to a standby position, and FIGS. 20E and 20F are a side view and a plan view when the support roller member is at the standby position;

DETAILED DESCRIPTION OF THE PREFERRED EMBODIMENTS

Referring to the accompanying drawings, embodiments of the present invention are described in detail below.

(Entire Configuration of Laser Beam Printer)

Figure 1:
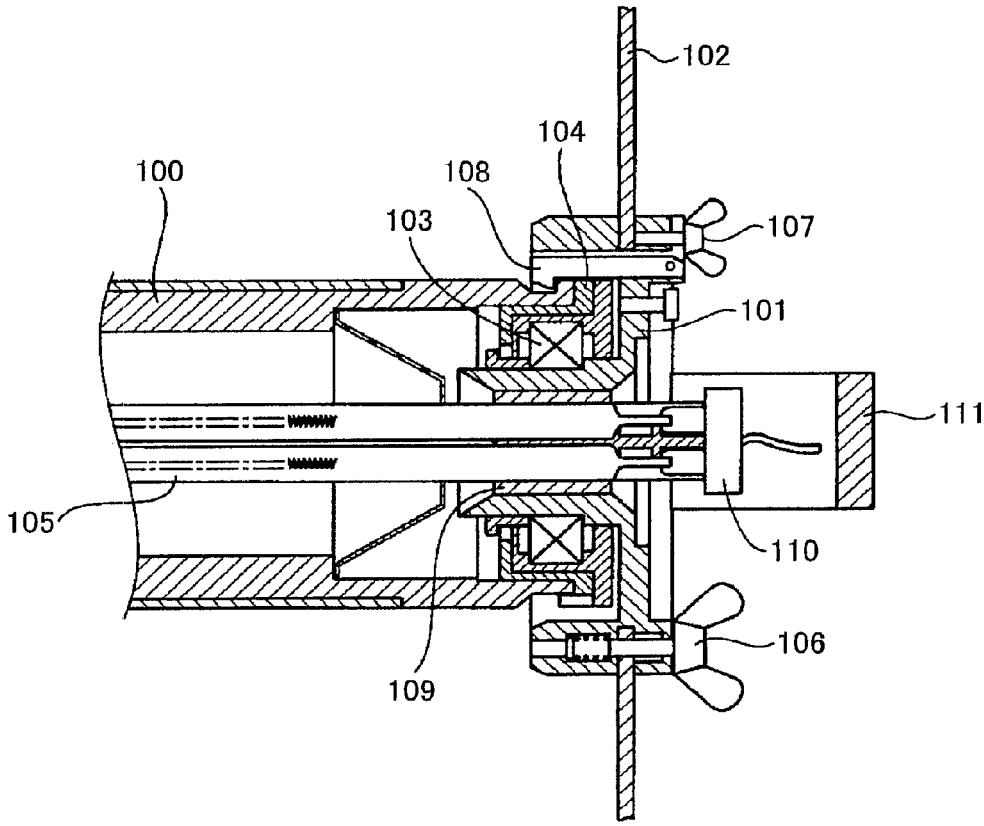
FIG.1 RELATED ART
FIG. 1 is a partial cross-sectional view of a conventional fixing unit.
Figure 2:
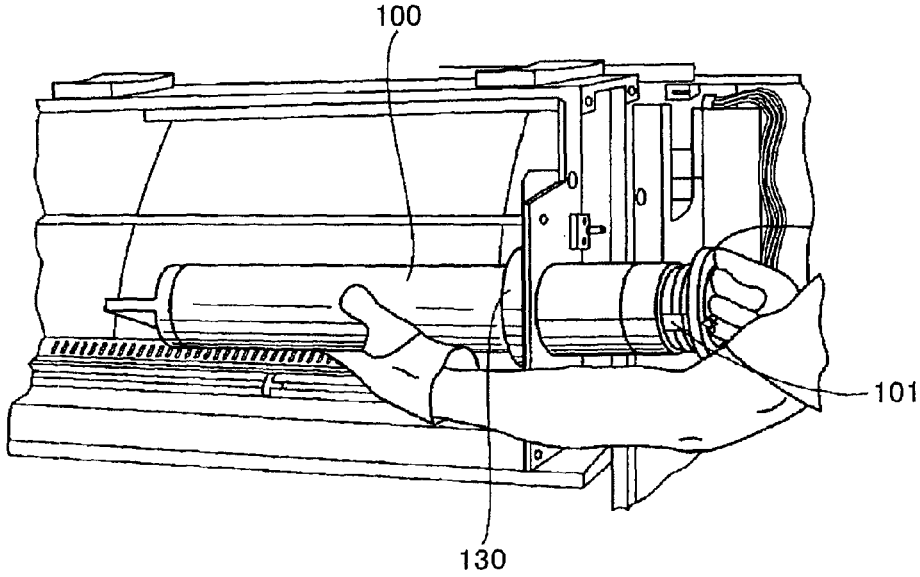
FIG.2 RELATED ART
FIG. 2 is a perspective view showing the heating roller of a fixing unit being replaced.
Figure 3:
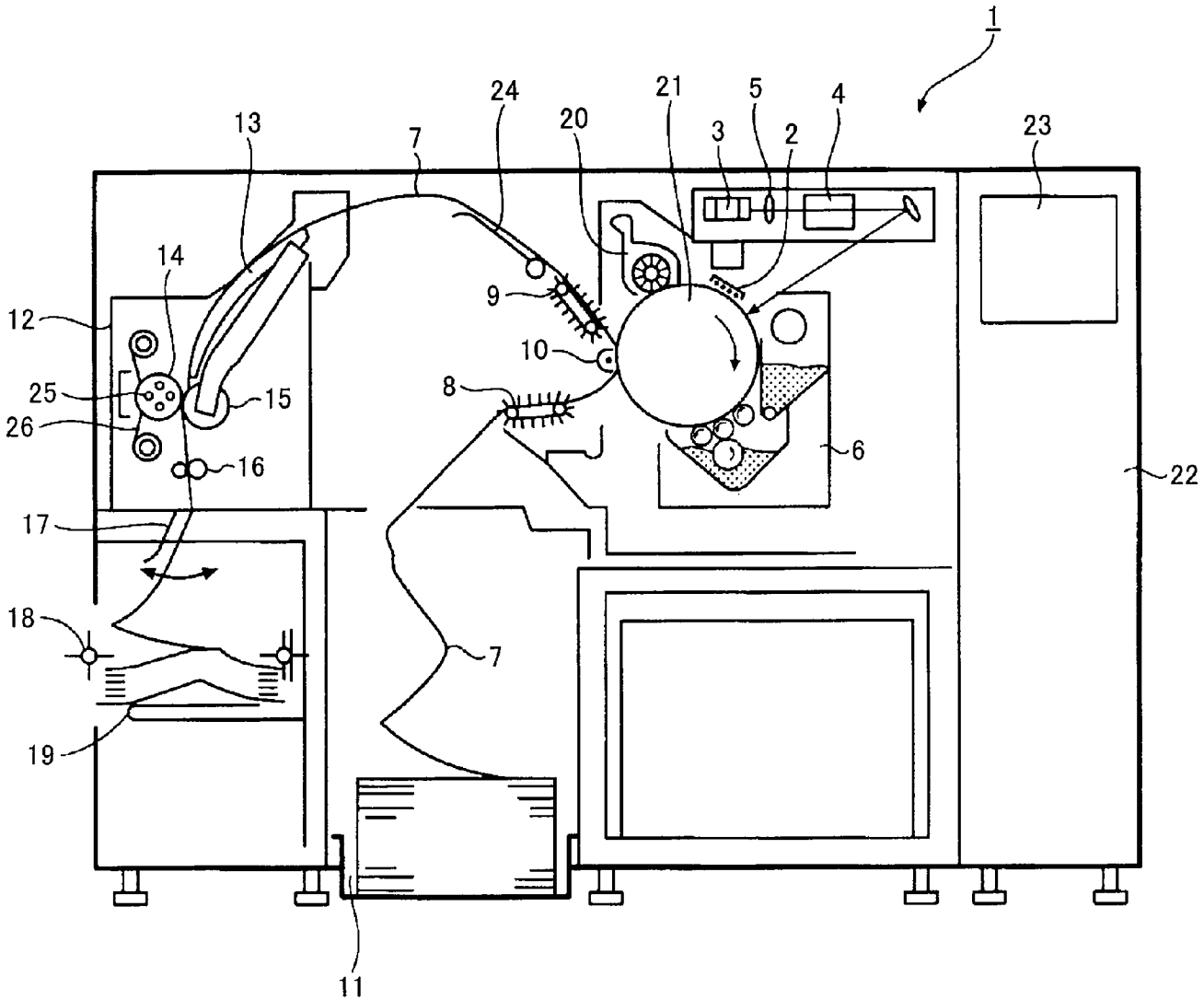
FIG. 3 is a schematic view of an image forming apparatus according to embodiments of the present invention.

Referring first to FIG. 3, a description is made of the entire configuration of an electro-photographic laser beam printer to which the embodiments of the present invention are applied.

In FIG. 3, reference numeral 1 denotes a laser beam printer, and a photosensitive drum 21 rotates in the direction as indicated by the arrow in accordance with a print-operation start signal from a controller 22. The photosensitive drum 21 rotates at a speed equivalent to the print speed of the laser beam printer 1 and continues its rotation until a print operation stops. When the photosensitive drum 21 starts its rotation, a high voltage is applied to a corona charger 2. Then, the corona charger 2 uniformly charges, for example, positive charges on the front surface of the photosensitive drum 21.

When power is supplied to the laser beam printer 1, a rotary polygon mirror 3 immediately starts its rotation. The rotary polygon mirror 3 maintains a constant-speed rotation with high accuracy while power is supplied to the laser beam printer 1. Light output from a light source 4 such as a semiconductor laser is reflected by the rotary polygon mirror 3 and irradiated on the photosensitive drum 21 through an f-θ lens 5 in a scanning manner. When text data and graphic data converted into dot images are supplied from the controller 22 to the laser beam printer 1 as on/off signals of a laser beam, some part of the front surface of the photosensitive drum 21 is irradiated with the laser beam but another part of the front surface of the photosensitive drum 21 is not irradiated. At this time, an electrostatic latent image is formed on the front surface of the photosensitive drum 21.

When the region of the photosensitive drum 21 maintaining the electrostatic latent image reaches a position opposite to a development unit 6, toner is supplied to the electrostatic latent image. For example, the positively-charged toner is attracted to a part on the photosensitive drum 21 where the charges are caused to disappear due to the irradiation of the laser beam, which in turn forms a toner image on the photosensitive drum 21.

A sheet conveyance tractor 8 conveys a continuous sheet (medium to be recorded) 7 accommodated in a sheet hopper 11 to a place between the photosensitive drum 21 and a transfer unit 10 in synchronization with a timing at which the toner image formed on the photosensitive drum 21 reaches a transfer position. The toner image formed on the photosensitive drum 21 is attracted onto the sheet 7 by the operation of the transfer unit 10 that applies charges having a polarity opposite to that of the toner image to the rear surface of the sheet 7.

Then, the sheet 7 is conveyed to a fixing unit 12 via the sheet conveyance tractor 8, the transfer unit 10, a sheet conveyance tractor 9, and a buffer plate 24. After reaching the fixing unit 12, the sheet 7 is preheated by a pre-heater 13 incorporating plural heaters and held and conveyed so as to be heated and pressed by a nip part having a pair of fixing rollers composed of a heating roller 14 and a pressure roller 15 each incorporating plural lamps 25. In this manner, the toner image is melted and fixed to the sheet 7.

The sheet 7 fed from the heating roller 14 and the pressure roller 15 is fed to a stacker table 19 by a sheet feeding roller 16 while being alternately folded along perforations by the swing operation of a swing fin 17. Moreover, the sheet 7 is stacked on the stacker table 19 so as to be accurately folded by a rotating paddle 18. The region of the photosensitive drum 21 having passed through the transfer position is cleaned by a cleaning unit 20 and on standby for the next print operation.

The buffer plate 24 is used for absorbing the slack or tension caused in the sheet 7 when there is a difference in a sheet conveyance speed between the sheet conveyance tractor 9 and the fixing rollers 14 and 15. Reference numeral 23 is a display screen for displaying information based on the status of the laser beam printer 1 during the print operation. Reference numeral 26 is a web member capable of contacting the front surface of the heating roller 14 and being wound up from the front surface of the heating roller 14, which is used for coating a toner releasing agent and a lubricant oil on the front surface of the heating roller 14.

(Structure Near Heating Roller)

Figure 4:
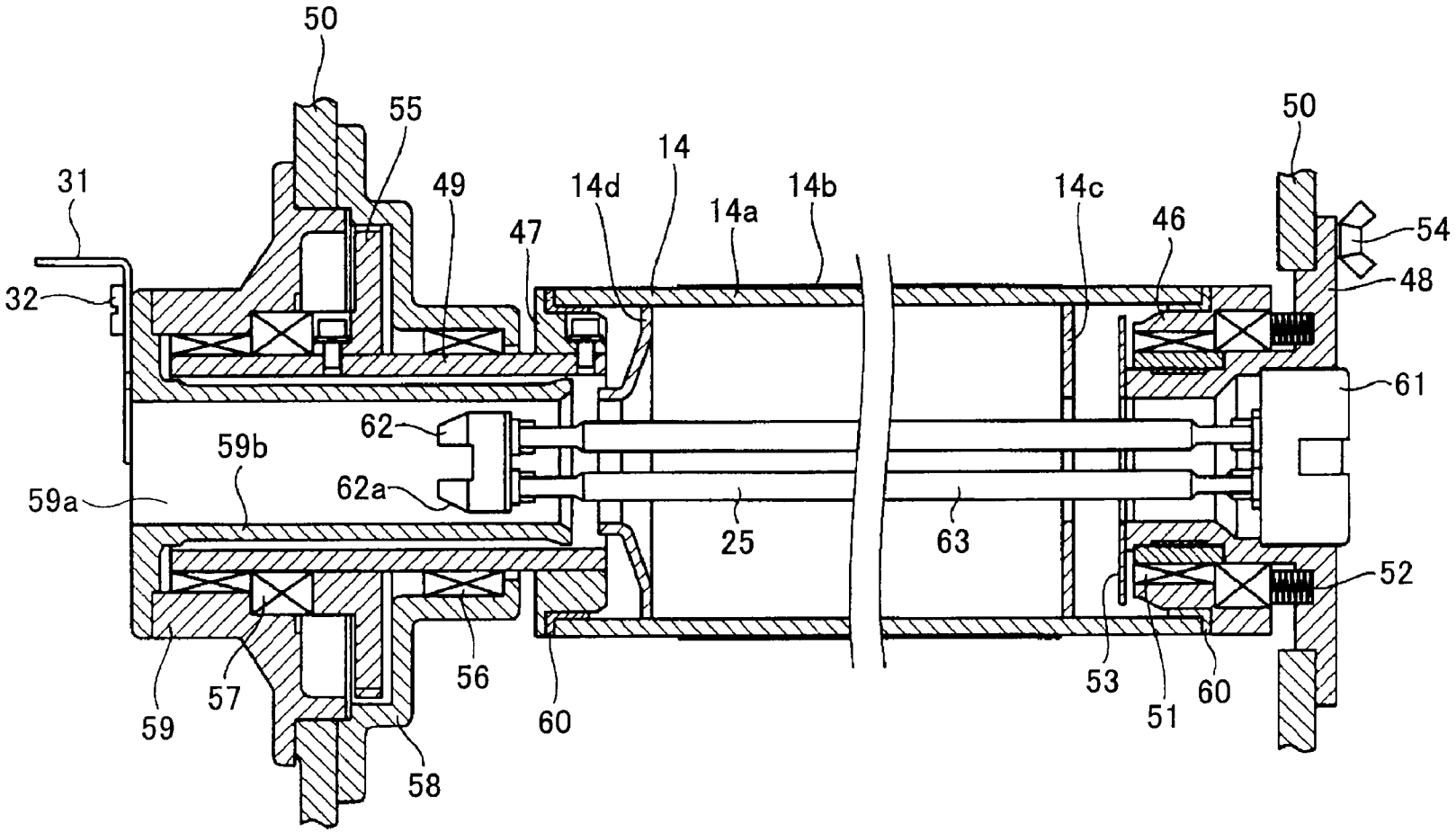
FIG. 4 is a cross-sectional view near a heating roller according to the embodiments of the present invention.

Referring next to FIG. 4, a description is made of a structure near the heating roller 14 of the fixing unit 12. The heating roller 14 is composed of a metal pipe 14*a* made of, for example, aluminum and a front surface layer 14*b* such as polytetrafluoroethylene and a silicon rubber provided on the sheet passage region of the peripheral surface of the pipe 14*a*. Inside areas near openings at both ends of the heating roller 14, heat transfer preventing members (hereinafter referred to as absorbers) 14*c* and 14*d* made of, for example, aluminum are fixed one at each end. The absorbers 14*c* and 14*d* prevent the temperature of an apparatus from rising due to the transfer of heat from the plural lamps 25 incorporated in the heating roller 14 to the outside of the heating roller 14.

The ends of the heating roller 14 are supported by frames 50 of the fixing unit 12 through holding members 48 and 49 having centering members 46 and 47, respectively.

The holding member 48 is provided with the centering member 46 through a bearing 51, and the centering member 46 is inserted inside the opening end of the heating roller 14. The bearing 51 can absorb the thermal expansion of the heating roller 14 and variations in peripheral support members with plural springs 52 provided in the axial direction of the bearing 51 and a stopper plate 53 arranged on an end surface inside the holding member 48. When being assembled with the heating roller 14, the plural springs 52 are somewhat compressed to form a gap between the centering member 46 and the bearing 51, and the stopper plate 53 as shown in FIG. 4. The holding member 48 is fixed to the frame 50 by plural wing screws 54.

The holding member 49 is provided with a gear 55 for receiving a driving force from a motor that rotates and drives the heating roller 14 and is rotatably supported by housings 58 and 59 through bearings 56 and 57, respectively. In order to prevent damage and the transfer of heat from the heating roller 14 to the centering members 46 and 47, heat-resistant plastic rings 60 are interposed between the corresponding ends of the heating roller 14 and the centering members 46 and 47. Note that the driving motor is a typical type.

The plural lamps 25 serving as the heat sources of the heating roller 14 constitute a lamp cartridge 63 bundled by lamp holders 61 and 62 that hold the corresponding ends of the plural lamps 25. The lamp cartridge 63 is provided at the center inside the heating roller 14 as shown in FIG. 4. In FIG. 4, reference numeral 31 denotes a stopper, and reference numeral 32 denotes a pin for fixing the stopper 31. As shown in FIG. 4, the lower end of the stopper 31 faces the inside of a through-hole 59*a* of the housing 59 in a normal state.

(Detachment and Attachment of Lamp Cartridge)

Figure 5:
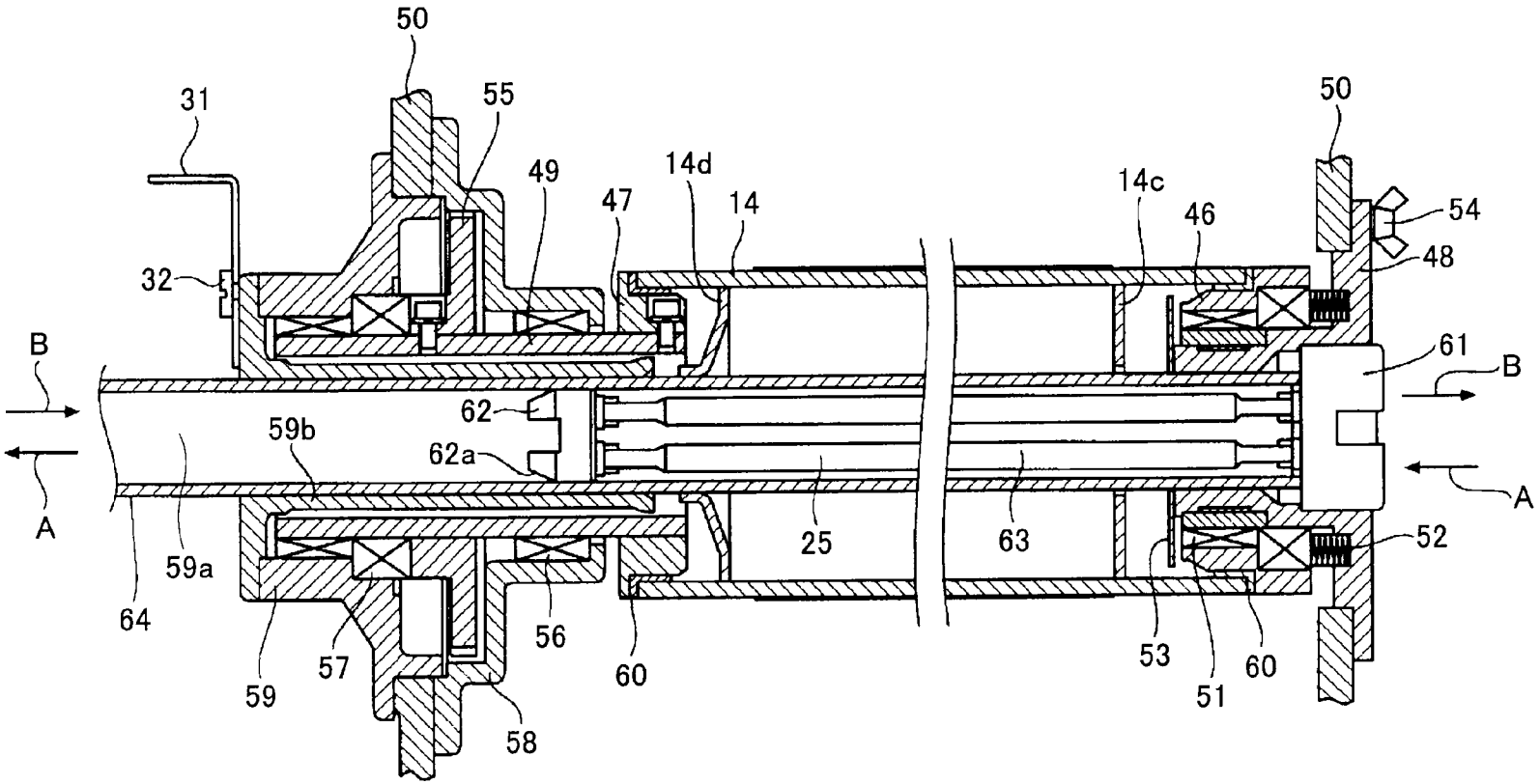
FIG. 5 is a cross-sectional view where a protection member is attached to the heating roller according to the embodiments of the present invention.

Referring next to FIG. 5, a description is made of the detachment and attachment of the lamp cartridge 63. When the lamp cartridge 63 or the heating roller 14 described below is being replaced, a protection member 64 made of, for example, a paper cylinder is used as shown in FIG. 5. The outer diameter of the protection member 64 is approximately the same in size as the inner diameter of the holding member 48 and the inner diameter of an inner cylinder 59*b* of the housing 59. Furthermore, the inner diameter of the protection member 64 is approximately the same in size as the outer diameter of the lamp holder 62. Furthermore, the length of the protection member 64 is slightly greater than the distance between the left and right frames 50.

When the lamp cartridge 63 is inserted in the heating roller 14, the protection member 64 covers the side of the lamp holder 62 and the right end of the protection member 64 is brought into contact with the end surface of the other lamp holder 61. The tip end part of the lamp holder 62 has an inclination 62*a* for facilitating the insertion of the protection member 64.

As shown in FIG. 5, the stopper 31 is fixed at an upper position by the pin 32 when the stopper 31 is lifted up. The lamp cartridge 63 having the protection member 64 attached is inserted from the side of the holding member 48 as indicated by the arrow A in FIG. 5, while the protection member 64 is guided by the holding member 48 and the inner cylinder 59*b* of the housing 59. The insertion of the lamp cartridge 63 is stopped when a part of the lamp holder 61 is brought into contact with the holding member 48. At this time, the tip end part of the protection member 64 in the inserting direction projects from the housing 59. Therefore, when the rest of the protection member 64 is extracted in the direction as indicated by the arrow A following the projecting part of the tip end part, the attachment of the lamp cartridge 63 is completed.

When the lamp cartridge 63 is extracted from the heating roller 14, the protection member 64 is inserted from the side of the through-hole 59*a* of the housing 59 as indicated by an arrow B in FIG. 5. At this time, the tip end part of the protection member 64 in the inserting direction is brought into contact with the end surface of the lamp holder 61 while being guided by the inner cylinder 59*b* of the housing 59, the inclination 62*a* of the lamp holder 62, and the holding member 48. When the protection member 64 is further inserted, the lamp cartridge 63 is pushed in the direction as indicated by the arrow B together with the protection member 64, which in turn makes it possible to extract the lamp cartridge 63. Thus, the plural lamps 25 can be collectively detached.

As described above, the insertion and the extraction of the lamp cartridge 63 covered with the protection member 64 can prevent damage to the plural lamps 25 during the handling of the lamp cartridge 63. Furthermore, the insertion and the extraction of the plural lamps 25 can be collectively performed.

Note that the paper cylinder as the protection member 64 is preferred because it has thermal insulating properties, predetermined mechanical strength, and is easily obtained due to its low cost.

First Embodiment (Configuration of Auxiliary Tool for Replacing Heating Roller)

Next, a description is made of an auxiliary tool for replacing the heating roller 14 according to a first embodiment of the present invention. The auxiliary tool according to this embodiment is composed of a guide shaft 30 (see, for example, FIG. 6) and an assist unit 40 (see, for example, FIG. 7).

Figure 6:
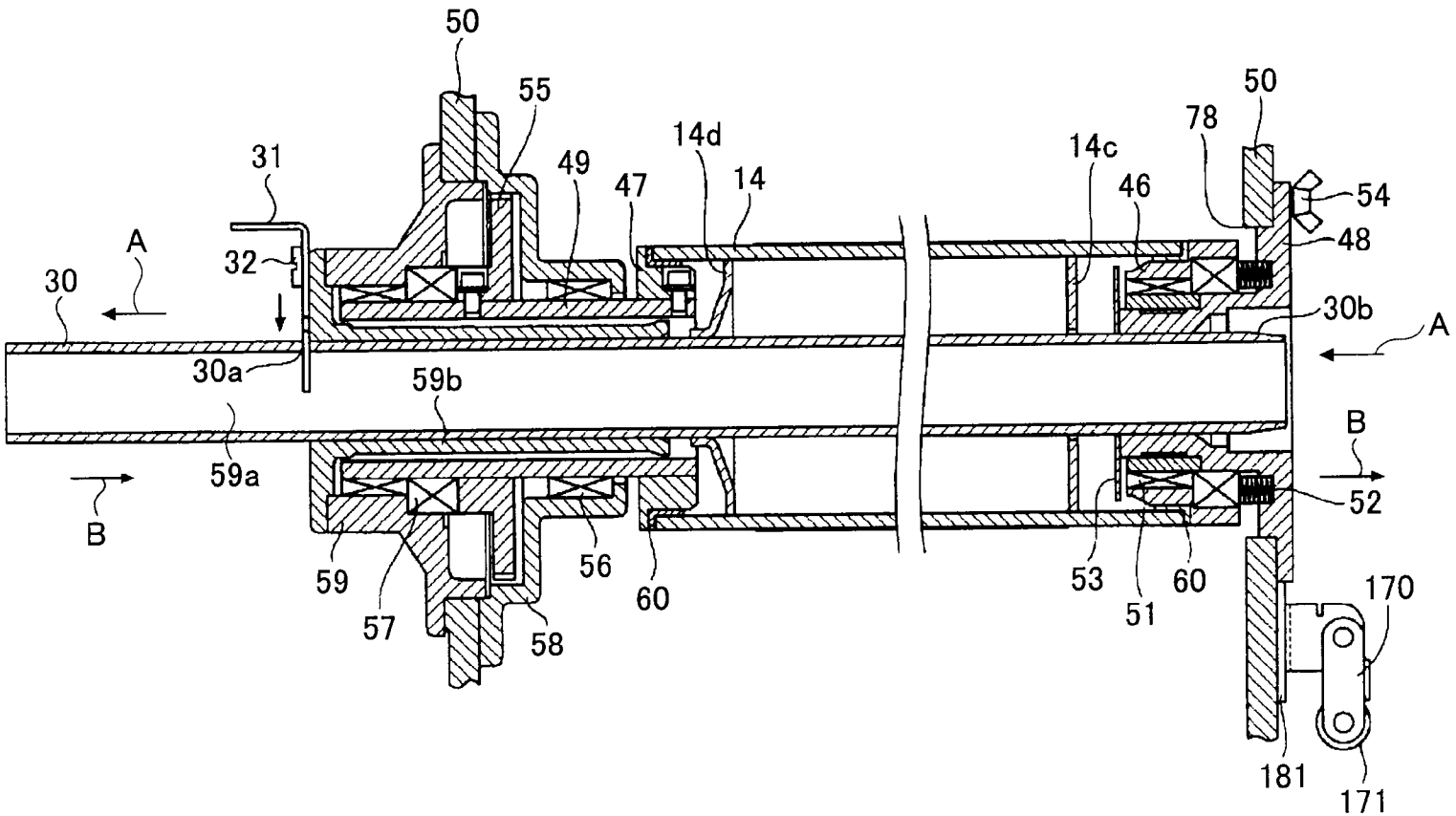
FIG. 6 is a cross-sectional view where a guide shaft is attached to the inside of the heating roller according to a first embodiment of the present invention.

The guide shaft 30 is made of a metal cylindrical body having rigidity. As shown in FIG. 6, the length of the guide shaft 30 is slightly longer than the distance between the left and right frames 50, and the outer diameter of the guide shaft 30 is approximately the same in size as the inner diameter of the holding member 48, the inner diameter of the absorber 14*d*, and the inner diameter of the inner cylinder 59*b* of the housing 59.

On the side surface of the housing 59, the plate-like stopper 31 for fixing (locking) the guide shaft 30 is slidably held by the pin 32. As shown in FIG. 6, a slit 30*a* is provided in the peripheral wall of the guide shaft 30 such that the stopper 31 is inserted in the guide shaft 30 when the guide shaft 30 is inserted into a predetermined position.

According to this embodiment, the plate-like stopper 31 is used, and the slit 30*a* is provided in the guide shaft 30. Alternatively, it is possible to use a pin-like stopper and provide a through-hole in the guide shaft 30 in which the pin-like stopper is inserted. Moreover, it is also possible to fix the guide shaft 30 to the housing 59 or the like in a detachable manner using a screw.

Fixing (Locking) the guide shaft 30 to a predetermined position as described above makes it possible to smoothly perform the inserting and extracting operation of the foregoing respective members without causing a positional shift of the guide shaft 30 when the heating roller 14, the holding member 48, and the assist unit 40 are inserted and extracted.

At the outer periphery of the tip end part of the guide shaft 30 in the inserting direction, an inclination surface 30*b* for smoothing the insertion of the assist unit 40 or the like is formed. When the guide shaft 30 is fixed to a predetermined position, the tip end part (inclination surface 30*b*) of the guide shaft 30 in the inserting direction slightly projects outward from the outside surface of the frame 50 (see FIG. 8).

Figure 9A:
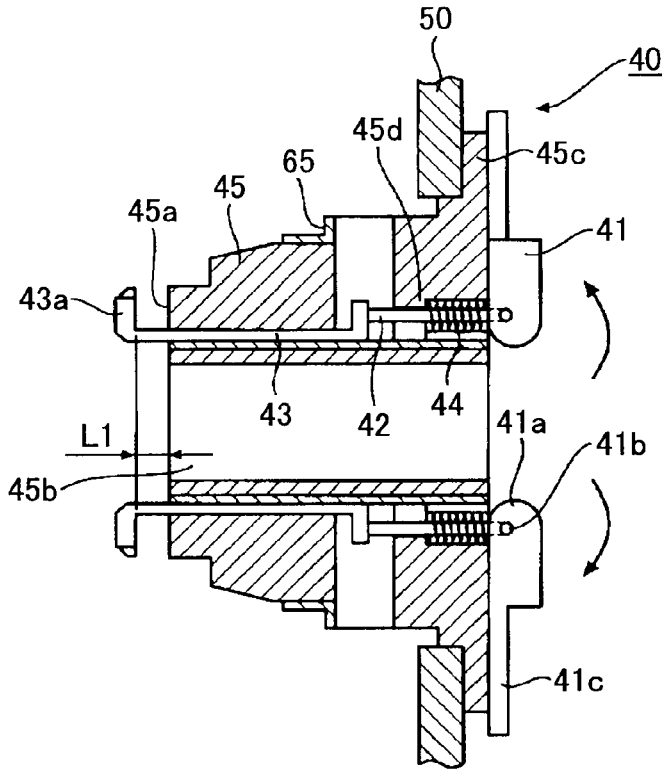
Figure 9B:
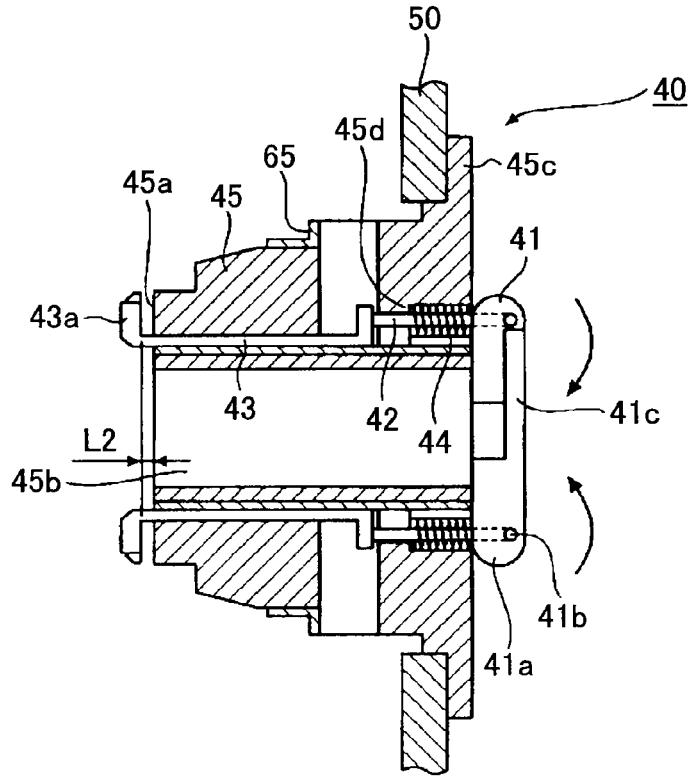
Figure 10:
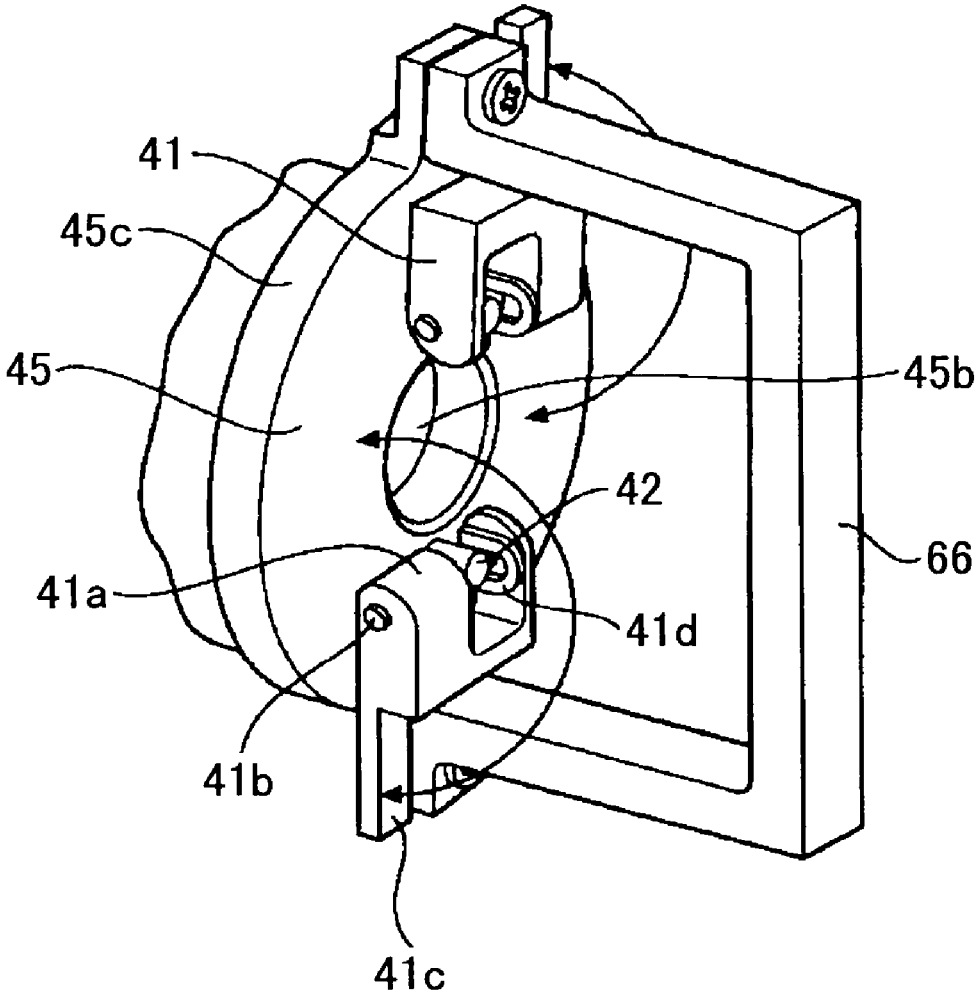
FIG. 10 is a partial perspective view of the assist unit according to the first embodiment of the present invention.

As shown in FIGS. 9A and 9B, the assist unit 40 is composed of a unit main body 45; two latches 41 rotatably attached to the side surface of the unit main body 45; shafts 42 that transmit the movements of the two latches 41 to a holder 43; the holder 43 that has one end linked to the shafts 42 and the other end folded toward an outside; coil-like springs 44 that absorb component tolerances to ensure the fixation to the heating roller 14; and a handle 66 (see FIG. 10) attached on the outer side surface of the unit main body 45. Note that as shown in FIG. 10, the rotating positions of lever parts 41*c* of the two latches 41 are offset from the attachment positions of the handle 66 on the unit main body 45, which prevents the handle 66 from interfering with the rotating operations of the lever parts 41*c*.

An insertion hole 45*b* penetrating along a shaft direction is provided at the center of the unit main body 45. A flange 45*c* is formed at one side surface of the unit main body 45. A ring 65 is provided at a position that the opening end of the heating roller 14 contacts when the heating roller 14 is being replaced. The inner diameter of the inserting hole 45*b* is approximately the same in size as the outer diameter of the guide shaft 30.

The two latches 41 are identical in shape. Each of the two latches 41 has a rotary part 41*a* which is formed at one end and whose side surface is shaped like a semicircle; a shaft part 41*b* provided inside the rotary part 41*a* so as to be off-center in the thickness direction of the rotary part 41*a*; and the lever part 41*c* provided opposite to the rotary part 41*a*. The two latches 41 are attached to the unit main body 45 such that the rotary parts 41*a* are opposite to each other across the inserting hole 45*b*.

First ends of the shafts 42 are linked to the corresponding shaft parts 41*b* of the latches 41. Furthermore, at the other end of the holder 43 opposite to the end linked to the shafts 42, holding pieces 43*a* are folded so as to be opposite to face an inner side surface 45*a* of the unit main body 45. As shown in FIGS. 9A and 9B, the coil-like springs 44 are interposed between a step-like spring receiving part 45*d* and the latches 41. The shafts 42 are inserted inside the springs 44, and the latches 41 are elastically biased to an outer direction at all times by the elastic force of the springs 44. However, each of the latches 41 has a locking unit 41*d* whose side surface is U-shaped (see FIG. 10).

Figure 7:
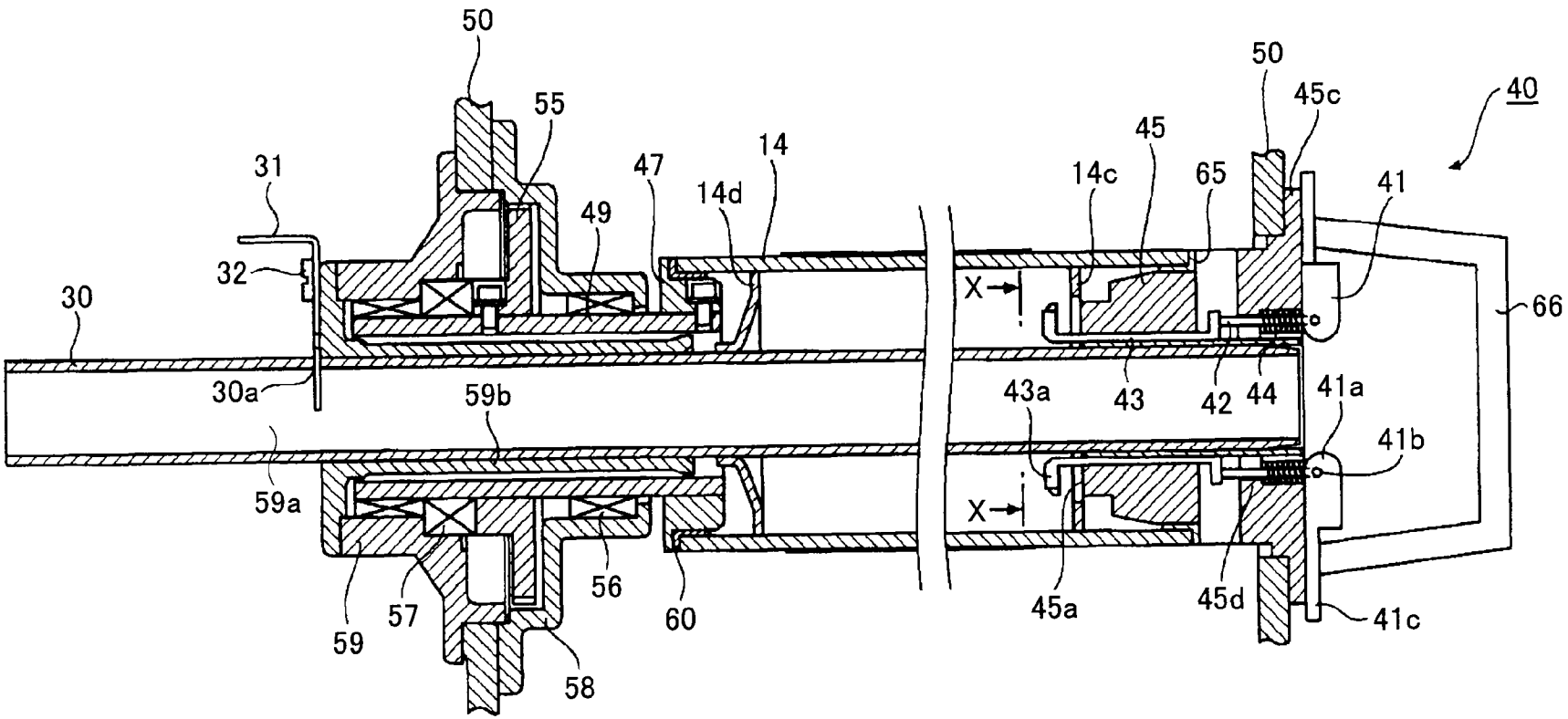
FIG. 7 is a cross-sectional view where an assist unit is inserted in the heating roller according to the first embodiment of the present invention.

FIG. 9A shows where the lever parts 41*c* of the two latches 41 are mutually directed outward. At this time, the shaft parts 41*b* of the latches 41 are positioned close to the unit main body 45. Therefore, an interval between the holding pieces 43*a* of the holder 43 and the inner side surface 45*a* of the unit main body 45 becomes large as indicated by L1. As shown in FIG. 7, the interval L1 is slightly larger than the thickness of the absorber 14*c*. FIG. 10 also shows where the lever parts 41*c* of the two latches 41 are mutually directed outward as in the case of FIG. 9A.

As shown in FIG. 9B, when the lever parts 41*c* of the two latches 41 are mutually rotated inward, the shaft parts 41*b* of the latches 41 are moved in a direction away from the unit main body 45. Along with the off-centering of the latches 41, the shafts 42 and the holder 43 are also moved, which in turn reduces the interval between the holding pieces 43*a* of the holder 43 and the inner side surface 45*a* of the unit main body 45 as indicated by L2. The interval L2 is slightly smaller than the thickness of the absorber 14*c*.

(Procedure for Replacing Heating Roller)

Next, a description is made of a procedure for replacing the heating roller 14. The heating roller 14 is replaced when it comes to the end of its service life or replaced so as to meet the demands of an image forming apparatus as described above.

Figure 11:
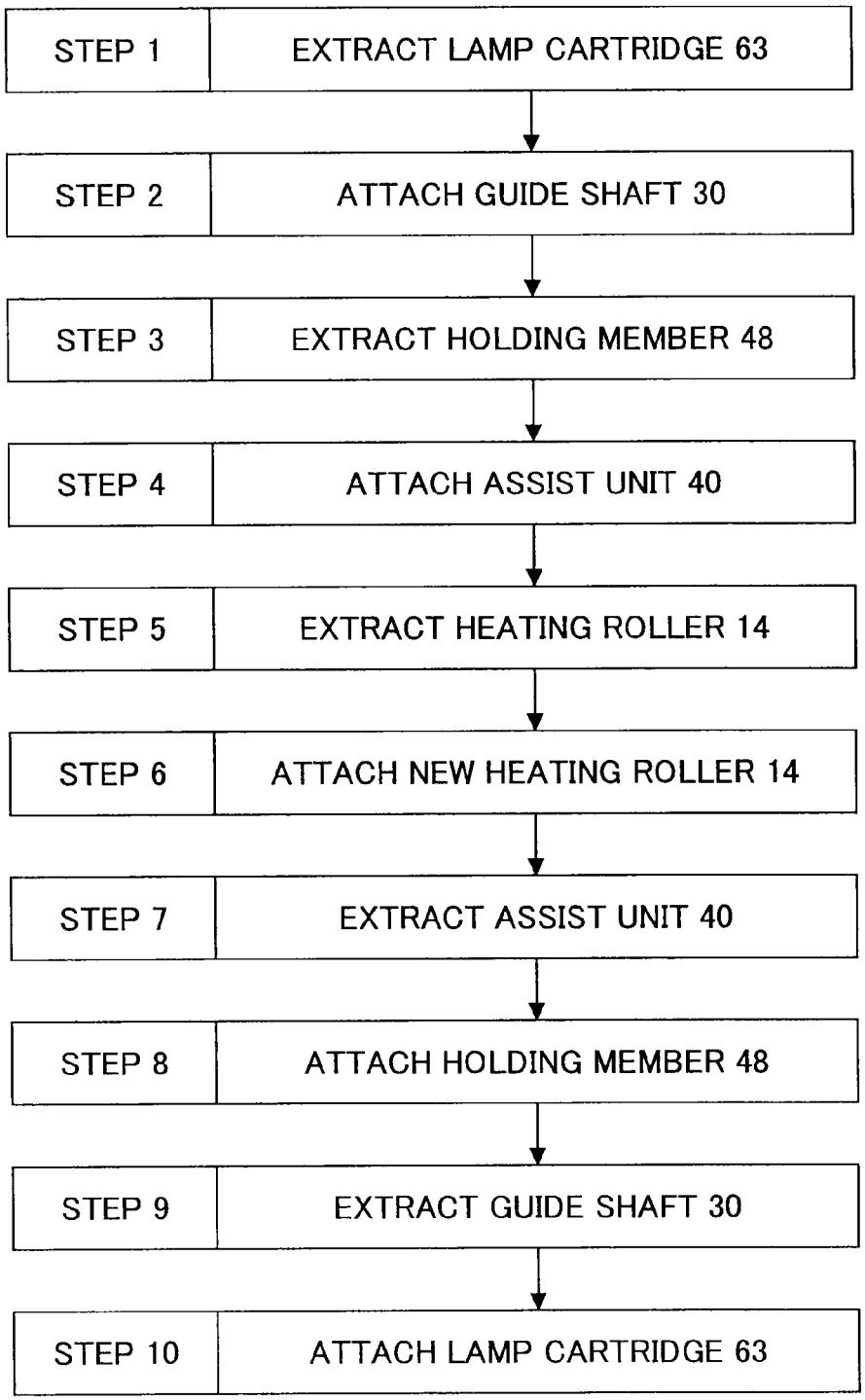
FIG. 11 is a step diagram showing a procedure for replacing the heating roller according to the embodiments of the present invention.

FIG. 11 is a step diagram showing the procedure for replacing the heating roller 14. As shown in FIG. 11, in step 1, the lamp cartridge 63 is extracted from the inside of the heating roller 14 by the use of the protection member 64. Since this operation is described above with reference to FIG. 5, its duplicated descriptions are omitted here. The extracted lamp cartridge 63 is covered with the rigid protection member 64. Therefore, the lamp cartridge 63 is not carelessly damaged during its replacement operation.

Next, in step 2, as shown in FIG. 6, the guide shaft 30 is inserted in the direction as indicated by the arrow B from the through-hole 59*a* of the housing 59. The guide shaft 30 is guided and held by the inner cylinder 59*b* of the housing 59, the absorber 14*d*, and the holding member 48. When the guide shaft 30 is inserted to a predetermined position, the stopper 31 is inserted in the slit 30*a* of the guide shaft 30, thereby completing the attachment of the guide shaft 30.

Then, in step 3, the wing screws 54 are loosened to extract the holding member 48 holding the centering member 46, the bearing 51, the springs 52, the stopper plate 53, and the like in the direction as indicated by the arrow B. At this time, the tip end part of the guide shaft 30 slightly projects outward from the outer side surface of the frame 50. Therefore, along with the guidance of the guide shaft 30, the holding member 48 can be smoothly extracted without colliding against the opening end of the frame 50. Note that since the centering member 46 is separated from the heating roller 14 while the holding member 48 is extracted, the centering member 46 and the bearing 51 are brought into contact with the stopper plate 53 by the restoration force of the springs 52.

Figure 8:
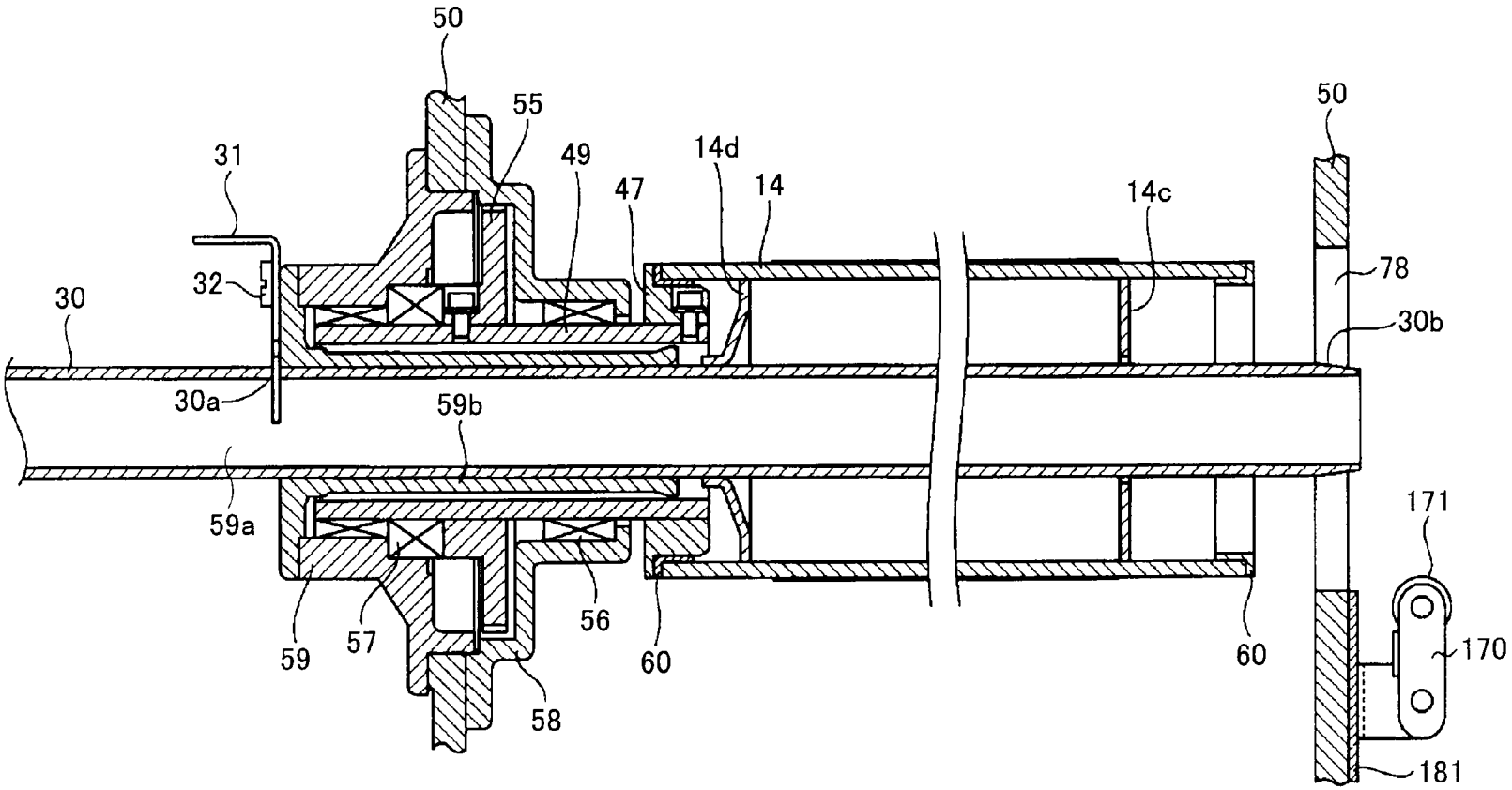
FIG. 8 is a cross-sectional view where the protection member is extracted from the heating roller.

In FIG. 6, the guide shaft 30 is attached and the holding member 48 is being extracted, whereas in FIG. 8, the holding member 48 has been extracted.

Next, in step 4, with the handle 66 being gripped, the assist unit 40 is inserted from the side of the tip end part of the guide shaft 30 having the inclination surface 30*b*. At this time, the lever parts 41 of the latches 41 are mutually directed outward as shown in FIG. 9A. Accordingly, the interval between the inner side surface 45*a* of the unit main body 45 and the holding pieces 43*a* of the holder 43 becomes large as indicated by L1.

Figure 12A:
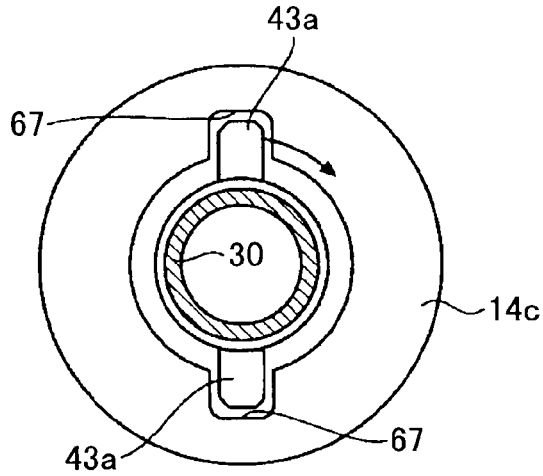
Figure 12B:
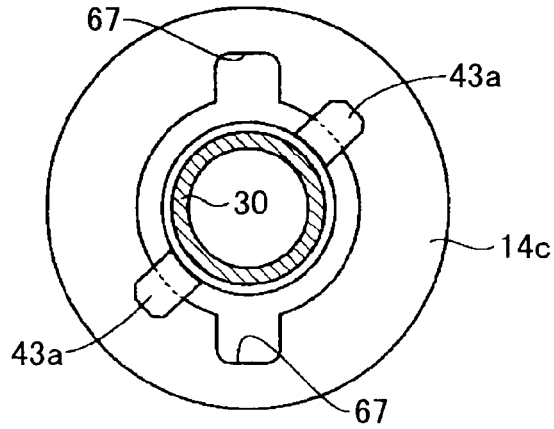

FIGS. 12A and 12B are diagrams showing a relationship between the absorber 14*c* and the holding pieces 43*a* of the holder 43 taken along the plane X-X in FIG. 7. FIG. 12A is a diagram showing when the assist unit 40 is inserted in the heating roller 14, and FIG. 12B is a diagram showing when the assist unit 40 is attached to the absorber 14*c*.

As shown in FIG. 12A, at the inner peripheral part of the absorber 14*c*, two cutouts 67 in which the holding pieces 43*a* of the holder 43 can be inserted are formed so as to be opposite to each other. As shown in FIG. 7, when the assist unit 40 is inserted in the heating roller 14, the holding pieces 43*a* of the holder 43 pass through the cutouts 67 and are placed on the left side of the absorber 14*c* in FIG. 7. When the flange 45*c* of the unit main body 45 is brought into contact with the outer side surface of the frame 50, the insertion of the assist unit 40 is stopped.

When the inserted assist unit 40 is rotated in the direction as indicated by the arrow in FIG. 12A with the handle 66 being gripped, the holding pieces 43*a* of the holder 43 are rotated away from the cutouts 67 and face the other inner peripheral part other than the cutouts 67 of the absorber 14*c* as shown in FIG. 12B. In other words, the other inner peripheral part of the absorber 14*c* intrudes between the inner side surface 45*a* of the unit main body 45 and the holding pieces 43*a* of the holder 43.

Figure 13:
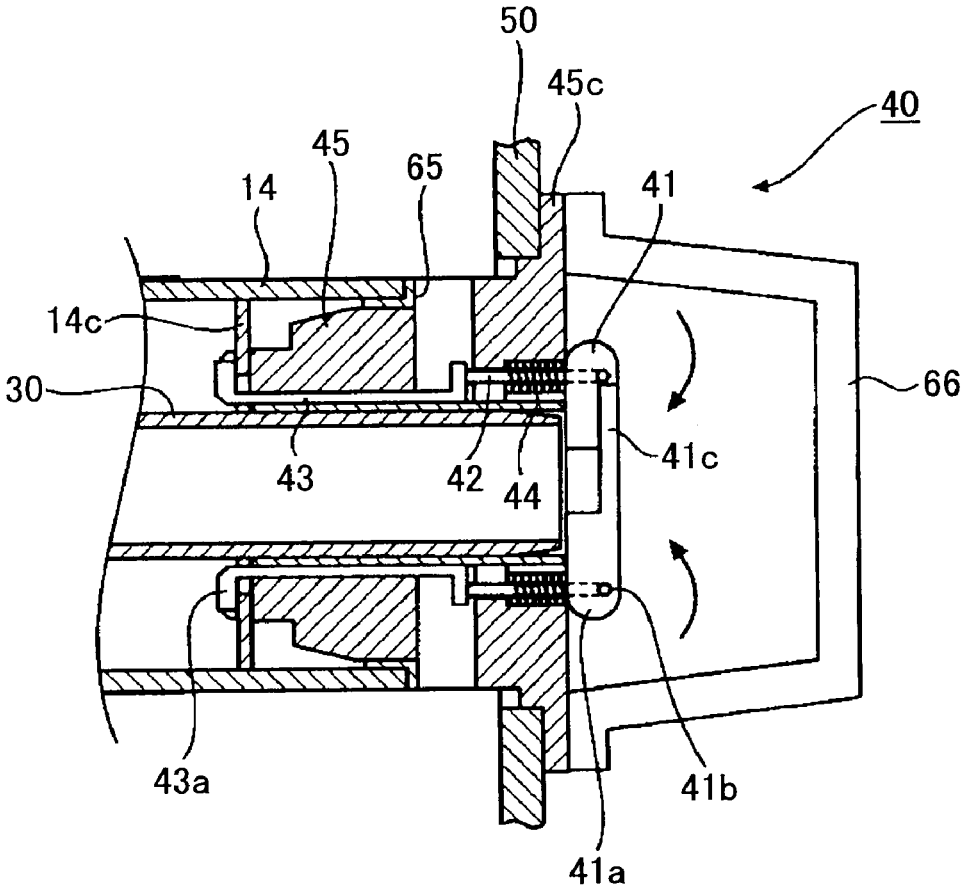
FIG. 13 is a cross-sectional view where the assist unit is attached to the heating roller according to the first embodiment of the present invention.

When the lever parts 41*c* of the latches 41 are mutually rotated inward as shown in FIG. 13, the holding pieces 43*a* of the holder 43 are drawn to the side of the unit main body 45 through the shafts 42, which in turn elastically hold the inner peripheral part of the absorber 14*c* between the holding pieces 43*a* of the holder 43 and the inner side surface 45*a* of the unit main body 45. Thus, the assist unit 40 is attached to the heating roller 14 through the absorber 14*c*.

Figure 14:
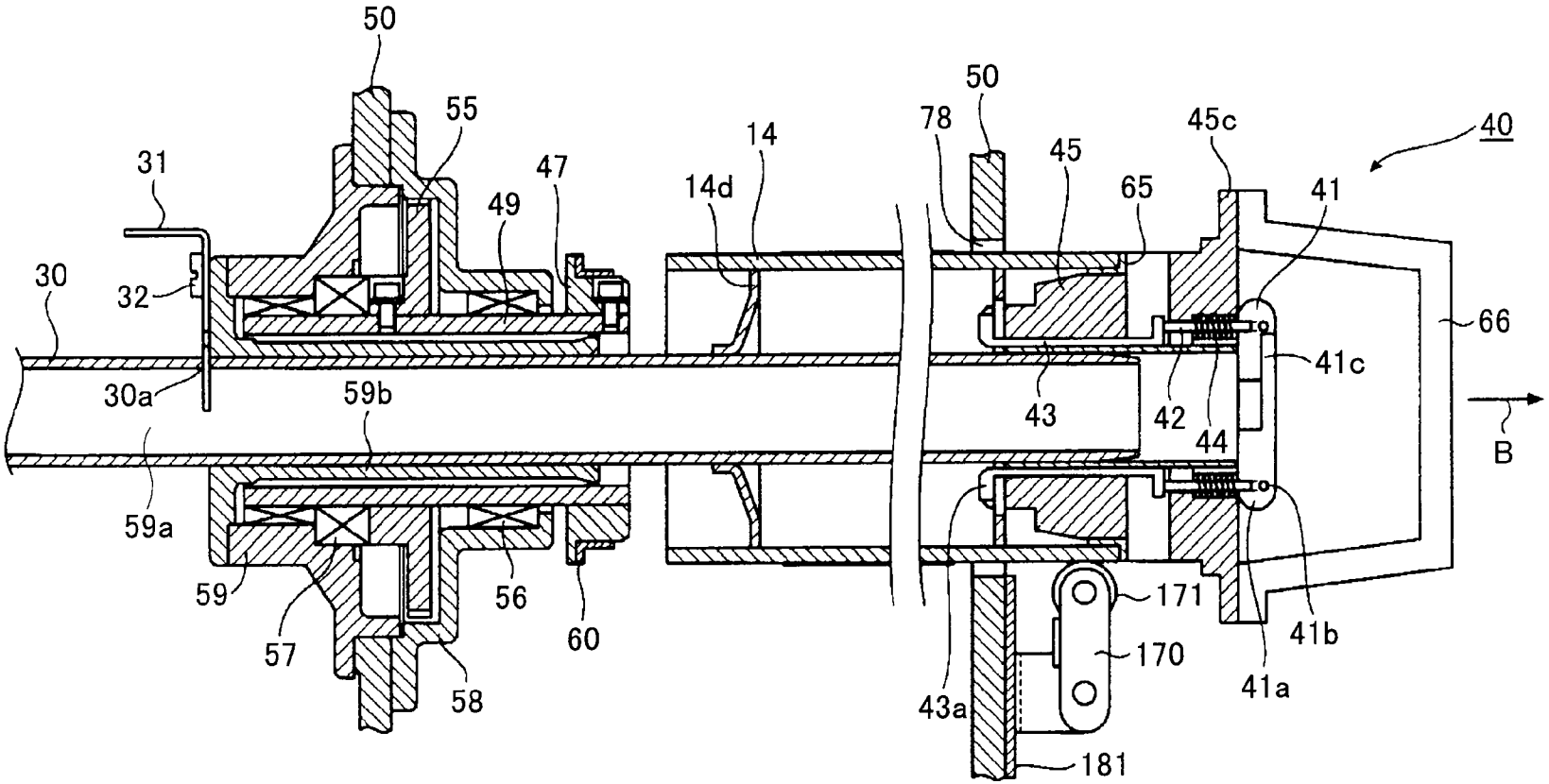
FIG. 14 is a cross-sectional view of the heating roller being extracted according to the first embodiment of the present invention.

Then, in step 5, the heating roller 14 at high temperature is extracted from the image forming apparatus with the handle 66 of the assist unit 40 being gripped. At this time, the guide shaft 30 is reliably held by the inner cylinder 59*b* of the housing 59, and the inner peripheral part of the absorber 14*d* slides on the outer peripheral surface of the guide shaft 30. Therefore, it is not necessary to manually hold a part of the heating roller 14 at high temperature, which enables the smooth and safe extraction of the heating roller 14. Even after the extraction of the heating roller 14, the centering member 47 and the holding member 49 remain as they are. FIG. 14 shows the heating roller 14 being extracted.

Next, in step 6, the assist unit 40 is attached to the new heating roller 14 for replacement, and the heating roller 14 is loaded by the use of the guide shaft 30. Note that the new heating roller 14 is not shown in the figures, but its basic configuration is the same.

Then, in step 7, the assist unit 40 is extracted from the heating roller 14. In step S8, the holding member 48 is attached by the use of the guide shaft 30. In step 9, the stopper 31 is disengaged to extract the guide shaft 30. In step 10, the lamp cartridge 63 covered with the protection member 64 is inserted in the heating roller 14, and then the holding member 48 is extracted from the heating roller 14, thereby completing the attachment of the lamp cartridge 63.

Note that since the attachment of the new heating roller 14 in step 6 is the inverse operation of the extraction of the heating roller 14 in step 5; the extraction of the assist unit 40 in step 7 is the inverse operation of the attachment of the assist unit 40 in step 4; the attachment of the holding member 48 in step 8 is the inverse operation of the extraction of the holding member 48 in step 3; the extraction of the guide shaft 30 in step 9 is the inverse operation of the attachment of the guide shaft 30 in step 2; and the attachment of the lamp cartridge 63 in step 10 is the inverse operation of the extraction of the lamp cartridge 63 in step 1, their descriptions are omitted here.

Second Embodiment

Referring next to the drawings, a description is made of a second embodiment of the present invention. Also in this embodiment, the auxiliary tool is composed of the guide shaft 30 and the assist unit 40 (see FIG. 15).

Figure 15:
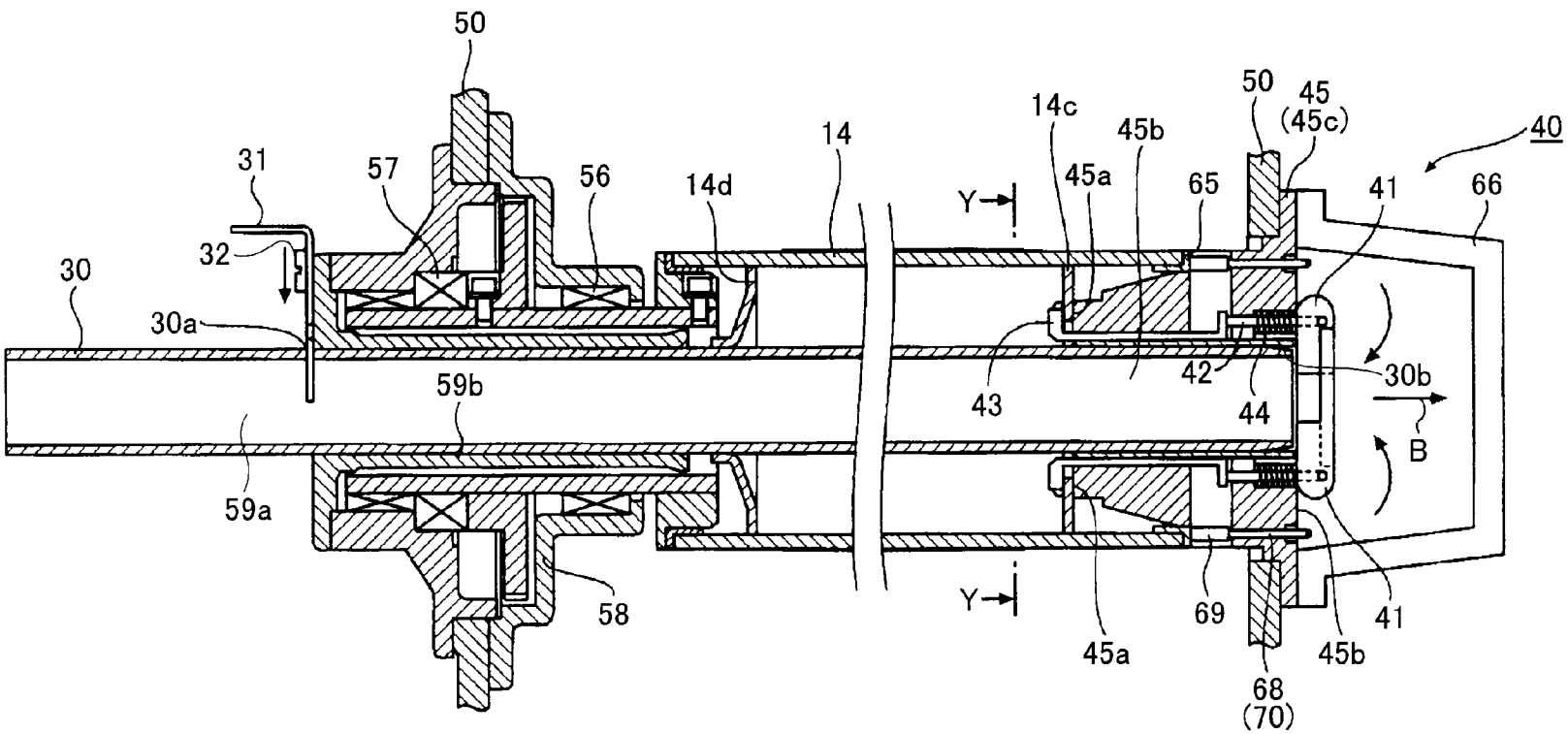
FIG. 15 is a cross-sectional view where the heating roller is about to be extracted according to a second embodiment of the present invention.

The guide shaft 30 is made of a metal cylindrical body having rigidity. As shown in FIG. 15, the length of the guide shaft 30 is slightly greater than the distance between the left and right frames 50, and the outer diameter of the guide shaft 30 is approximately the same in size as the inner diameter of the holding member 48 (see FIG. 6), the inner diameter of the absorber 14*d*, and the inner diameter of the inner cylinder 59*b* of the housing 59. Even when the lamp cartridge 63 is completely extracted from the frames 50 of the fixing unit 12 (see FIG. 8), the guide shaft 30 is configured to be fit in the absorbers 14*c* and 14*d* that prevent the transfer of heat from the corresponding ends of the heating roller 14.

The slit 30*a* is formed in a part of the cylindrical part of the guide shaft 30. The guide shaft 30 is shaped such that the stopper 31 provided in the fixing unit 12 can enter the guide shaft 30 from the direction as indicated by the arrow in FIG. 15 when the guide shaft 30 is fixed to the fixing unit 12. Furthermore, at the tip end part of the guide shaft 30 in the inserting direction, the inclination surface 30*b* for smoothing the fitting of the assist unit 40 is formed.

When the guide shaft 30 is attached to the fixing unit 12, it is inserted from the backside (left side in FIG. 15) of the image forming apparatus through the through-hole 59*a* provided in the housing 59. At this time, the guide shaft 30 is inserted in the fixing unit 12 until the inclination surface 30*b* of the guide shaft 30 slightly collides against the forward frame 50 (on the right side in FIG. 15) of the image forming apparatus. Then, when the stopper 31 is lowered in the direction as indicated by the arrow and inserted in the slit 30*a*, the guide shaft 30 is locked at (fixed to) a predetermined position.

The assist unit 40 has the unit main body 45, the two latches 41, the shafts 42, the holder 43, the coil-like springs 44, the handle 66, and at least two push pins 68. The two latches 41 are attached on the side surface of the unit main body 45 in a manner capable of being rotated in the directions as indicated by the arrows and enable/disable the engagement with the end of the heating roller 14. The shafts 42 transmit the movements of the latches 41 to the holder 43. The holder 43 holds the absorber 14*c* at the inner end of the heating roller 14 between the holder 43 and the heating roller 14 so as to engage the heating roller 14 with the assist unit 40. The coil-like springs 44 absorb component tolerances to ensure the fixation to the heating roller 14. The handle 66 is attached on the outer side surface 45*b* of the unit main body 45. The two push pins 68 are arranged near the outer peripheral part of the unit main body 45 at even intervals. According to this embodiment, the push pins are the same in number as the latches 41 and arranged so as to have an interval of 180° with each other.

Note that the rotating positions of the lever parts 41*c* of the two latches 41 and the arrangement positions of the push pins 68 on the unit main body 45 are offset from the attachment positions of the handle 66, which in turn prevents the handle 66 from interfering with the rotating operations of the lever parts 41*c* (see FIG. 10).

This embodiment is different from the first embodiment in that it has the push pins (separation units) 68 provided in the assist unit 40. The push pins 68 are provided to correspond to a case in which the assist unit 40 at high temperature cannot be easily extracted from the heating roller 14 because the heating roller 14 is deformed by heat. In such a case, the assist unit 40 is forcibly manually extracted with the heating roller 14 being gripped. However, it is dangerous to handle the heating roller 14 due to its high temperature and takes time to extract the assist unit 40 from the heating roller 14, which in turn reduces the efficiency of the operation itself. In order to prevent this, the application of force from the assist unit 40 in the shaft direction of the heating roller 14 makes it possible to easily and safely extract the assist unit 40 from the heating roller 14.

Figure 16:
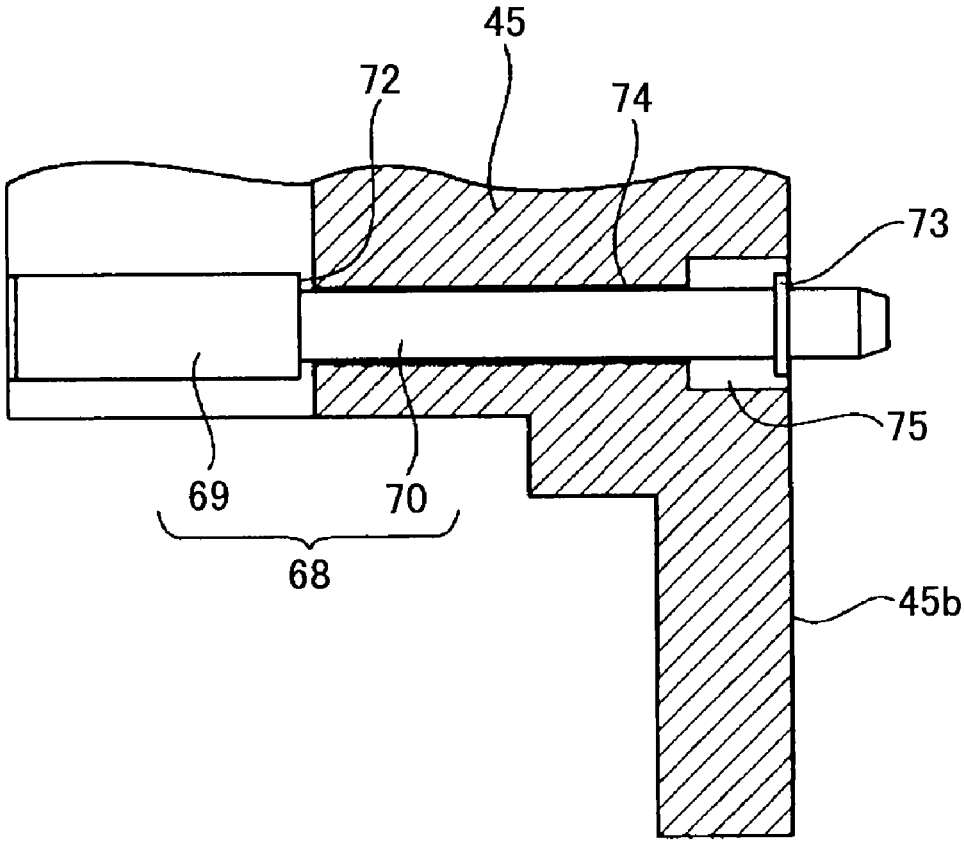
FIG. 16 is an enlarged cross-sectional view near a push pin according to the second embodiment of the present invention.

As shown in FIGS. 15 and 16, each of the push pins 68 is composed of a large-diameter part 69 opposite to the end surface of the heating roller 14 and a small-diameter part 70 opposite to the lever part 41*c* of the latch 41. A step part 72 is formed at a boundary between the large-diameter part 69 and the small-diameter part 70. Furthermore, a locking ring 73 is fixed at a part near the head part of the small-diameter part 70.

As shown in FIG. 16, the small-diameter parts 70 of the push pins 68 are inserted in the through-holes 74 provided at parts near the outer peripheral part of the unit main body 45 and supported in a manner capable of being moved in the shaft direction of the heating roller 14 by the guide of the through-holes 74. On the side opposite to the lever parts 41*c* of the through-holes 74, recessed cutout parts 75 having an inner diameter larger than the outer diameter of the locking ring 73 are formed.

The step parts 72 of the push pins 68 are configured to be opposite to first opening ends of the through-holes 74 and the locking rings 73 are configured to be opposite to the bottom surface of the recessed cutout parts 75, which prevents the push pins 68 from dropping off the unit main body 45 when the assist unit 40 is handled.

Figure 17A:
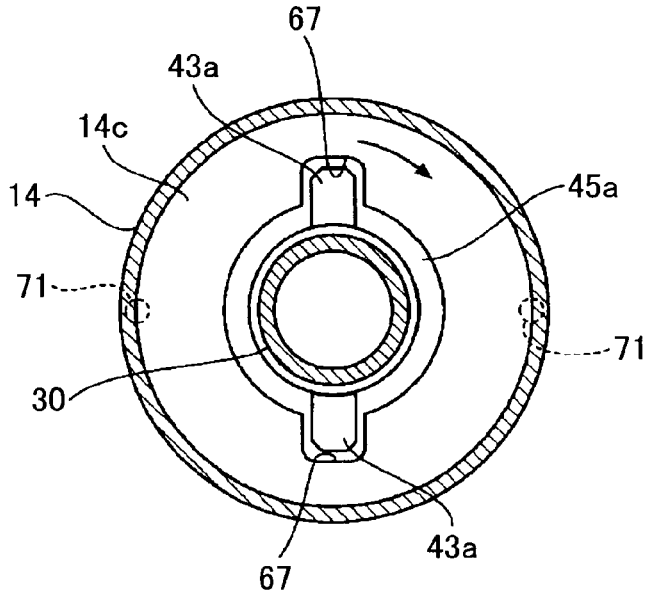
Figure 17B:
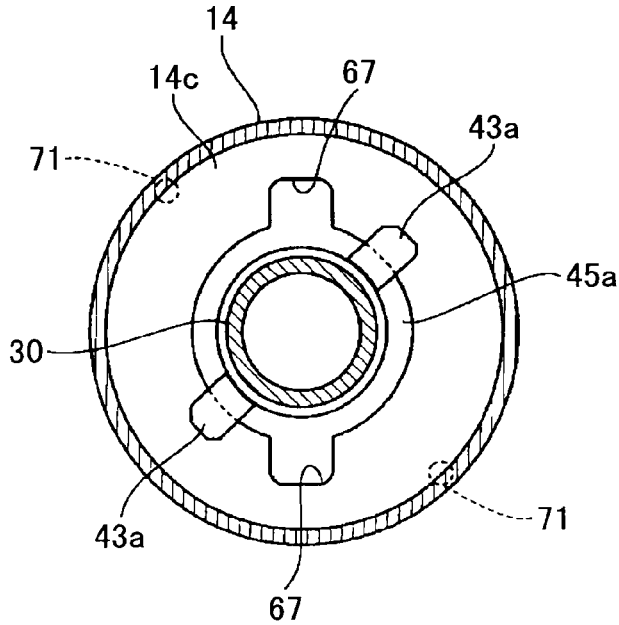
Figure 18A:
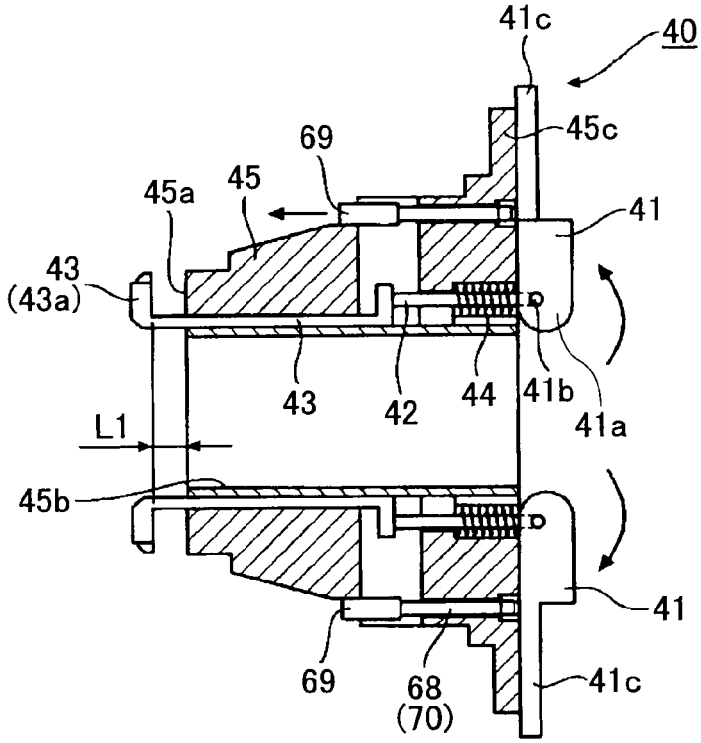

Furthermore, the push pins 68 are provided at positions opposite to the end surface of the heating roller 14 as indicated by dotted small circles 71 in FIGS. 17A and 17B and provided at positions opposite to the lever parts 41*c* of the latches 41 as shown in FIG. 18A.

Figure 18B:
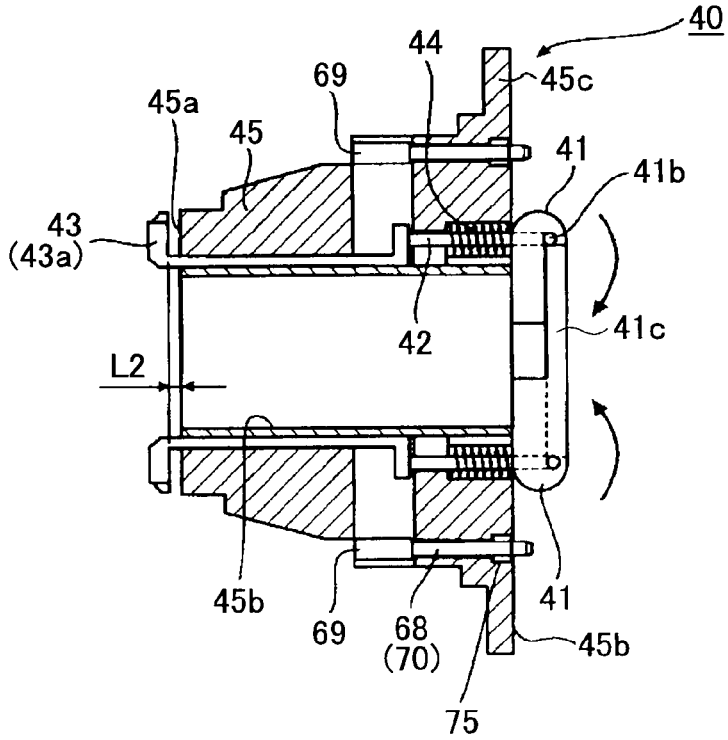

The length of the push pins 68 is such that the small-diameter parts 70 slightly project from the outer side surface of the unit main body 45 where the latches 41 are mutually directed inward as shown in FIG. 18B. On the other hand, the length of the push pins 68 is such that the large-diameter parts 69 are pressed by the lever parts 41*c* of the latches 41 and project from the outer peripheral part of the unit main body 45*a* when the latches 41 are mutually directed outward as shown in FIG. 18A.

Figure 19:
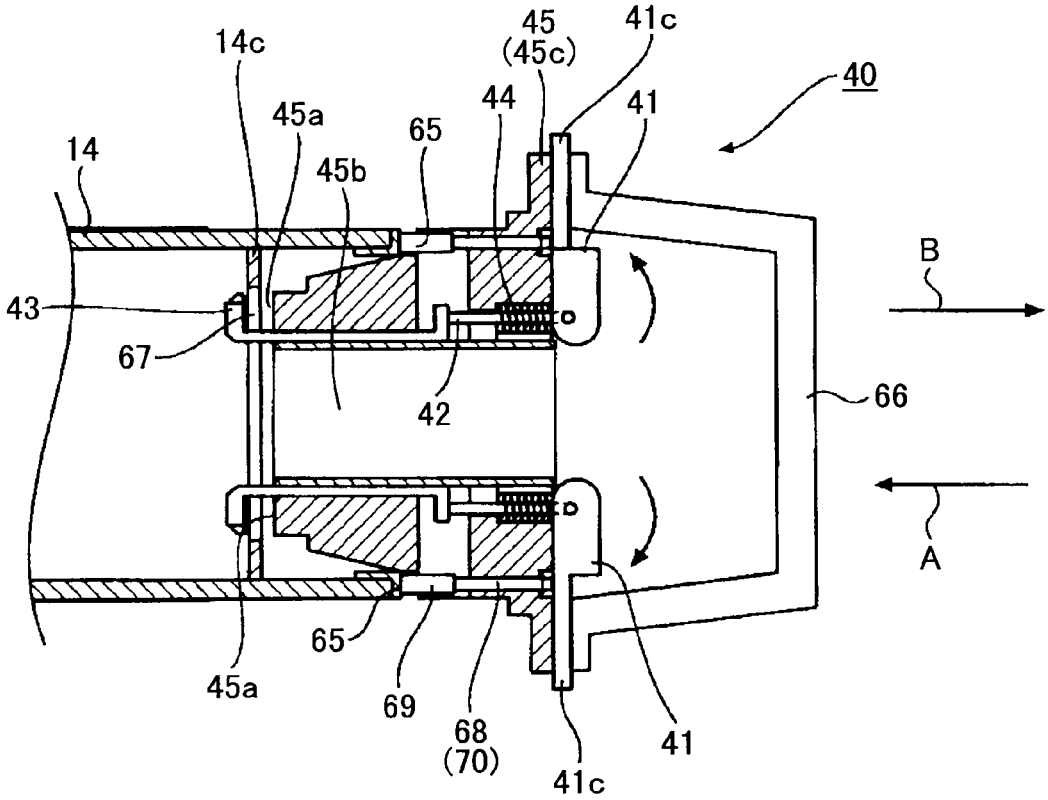
FIG. 19 is a partial cross-sectional view for explaining the operation of attaching and detaching the assist unit to and from the heating roller according to the second embodiment of the present invention.

In FIG. 18A, the lever parts 41*c* of the two latches 41 are mutually directed outward. At this time, the shaft parts 41*b* of the latches 41 are positioned close to the unit main body 45. Therefore, an interval between the holding pieces 43*a* of the holder 43 and the inner side surface 45*a* of the unit main body 45 becomes large as indicated by L1. As shown in FIG. 19, the interval L1 is slightly larger than the thickness of the absorber 14*c*.

At this time, the push pins 68 are pressed by the lever parts 41*c* of the latches 41, which causes the large-diameter parts 69 to slightly project from the outer peripheral part of the unit main body 45*a*. Similarly to the case of FIG. 18A, FIG. 19 also shows the lever parts 41*c* of the two latches being mutually directed outward.

As shown in FIG. 18B, when the lever parts 41*c* of the two latches 41 are mutually rotated inward, the shaft parts 41*b* of the latches 41 are moved in a direction away from the unit main body 45. Along with the off-centering of the latches 41, the shafts 42 and the holder 43 are also moved, which in turn narrows the interval between the holding pieces 43*a* of the holder 43 and the side surface 45*a* of the unit main body 45 as indicated by L2. The interval L2 is slightly smaller than the thickness of the absorber 14*c*. At this time, the lever parts 41*c* of the latches 41 are offset from the push pins 68, and the large-diameter parts 69 are accommodated inside the unit main body 45*a*. Instead, the small-diameter parts 70 project from the outer side surface of the unit main body 45. The large-diameter parts 60 are provided to obtain as large a contact area as possible with the heating roller 14.

The small interval L2 causes the assist unit 40 to be engaged with the absorber 14*c*. Therefore, the heating roller 14 and the assist unit 40 are integrated with each other, which in turn makes it possible to insert and extract the assist unit 40 in and from the fixing unit 12. Furthermore, as shown in FIG. 18A, the large interval L1 causes the assist unit 40 to be disengaged from the absorber 14*c* and the large-diameter parts 69 of the push pins 68 to project from the outer peripheral part of the unit main body 45*a* in the direction as indicated by the arrow to push the end surface of the heating roller 14 through the rings 65 (see FIG. 19). Thus, the assist unit 40 is automatically separated from the heating roller 14. Note that the rings 65 are made of a synthetic resin having heat resistance, which provides good insulation. Note that the large-diameter parts 69 are provided on the side opposite to (facing) the end surface of the heating roller 14 of the push pins 68 so as to increase an opposed area to the end surface of the heating roller 14.

(Procedure for Replacing Heating Roller)

Next, a description is made of a procedure for replacing the heating roller 14. Similar to the case of the first embodiment, the heating roller 14 is replaced when it comes to the end of its service life or replaced so as to meet the demands of an image forming apparatus as described above.

FIG. 11 is the step diagram showing the procedure for replacing the heating roller 14. As shown in FIG. 11, in step 1, the lamp cartridge 63 is extracted from the inside of the heating roller 14 by the use of the protection member 64. Since this operation is described above with reference to FIG. 5, its duplicated descriptions are omitted here.

Next, in step 2, as shown in FIG. 6, the guide shaft 30 is inserted in the direction as indicated by the arrow B from the through-hole 59*a* of the housing 59. The guide shaft 30 is guided and held by the inner cylinder 59*b* of the housing 59, the absorber 14*d*, and the holding member 48. When the insertion of the guide shaft 30 reaches a predetermined position, the stopper 31 is inserted in the slit 30*a* of the guide shaft 30, thereby completing the attachment of the guide shaft 30.

Then, in step 3, the wing screws 54 are loosened to extract the holding member 48 holding the centering member 46, the bearing 51, the springs 52, the stopper plate 53, and the like in the direction as indicated by the arrow B. At this time, the tip end part of the guide shaft 30 slightly projects outward from the outer side surface of the frame 50. Therefore, along with the guidance of the guide shaft 30, the holding member 48 can be smoothly extracted without colliding against the opening end of the frame 50.

FIG. 6 shows where the guide shaft 30 is attached and the holding member 48 is being extracted, whereas FIG. 8 shows the extracted the holding member 48.

Next, in step 4, with the handle 66 being gripped, the assist unit 40 is inserted from the side of the tip end part of the guide shaft 30 having the inclination surface 30*b*. At this time, the lever parts 41 of the latches 41 are mutually directed outward as shown in FIG. 18A. Accordingly, the interval between the inner side surface 45*a* of the unit main body 45 and the holding pieces 43*a* of the holder 43 is kept large as indicated by L1. Furthermore, the large-diameter parts 69 of the push pins 68 project from the outer peripheral part of the unit main body 45.

FIGS. 17A and 17B are diagrams showing a relationship between the absorber 14*c* and the holding pieces 43*a* of the holder 43 taken along the place Y-Y in FIG. 15. FIG. 17A is a diagram showing when the assist unit 40 is inserted in the heating roller 14, and FIG. 17B is a diagram when the assist unit 40 is attached to the absorber 14*c*.

As shown in FIGS. 17A and 17B, at the inner peripheral part of the absorber 14*c*, the two cutouts 67 in which the holding pieces 43*a* of the holder 43 can be inserted are formed so as to be opposite to each other. As shown in FIG. 19, when the assist unit 40 is inserted in the heating roller 14, the holding pieces 43*a* of the holder 43 pass through the cutouts 67 and are placed on the left side of the absorber 14*c* in FIG. 19. When the large-diameter parts 69 of the push pins 68 are brought into contact with the end surface of the heating roller 14 through the rings 65, the insertion of the assist unit 40 is stopped.

As shown in FIG. 17A, when the assist unit 40 is rotated in the direction as indicated by the arrow with the handle 66 being gripped, the holding pieces 43*a* of the holder 43 are rotated from the cutouts 67 and face the other inner peripheral part of the absorber 14*c* as shown in FIG. 17B. In other words, the other inner peripheral part of the absorber 14*c* intrudes between the holding pieces 43*a* of the holder 43 and the inner side surface 45*a* of the unit main body 45. Even if the assist unit 40 is rotated, the arrangement positions 71 of the push pins 68 are opposite to (face) the end surface of the heating roller 14 as shown in FIG. 17B.

When the lever parts 41*c* of the latches 41 are mutually rotated inward as shown in FIGS. 15 and 18B, the lever parts 41*c* are separated from the push pins 68 and the holding pieces 43*a* of the holder 43 are drawn to the side of the unit main body 45 through the shafts 42, which in turn elastically holds the inner peripheral part of the absorber 14*c* between the holding pieces 43*a* of the holder 43 and the inner side surface 45*a* of the unit main body 45 and causes the ends of the small-diameter parts 70 of the push pins 68 to project from the outer side surface 45*b* of the unit main body 45. Thus, the assist unit 40 is attached to the heating roller 14 through the absorber 14*c*.

Then, in step 5, the heating roller 14 at high temperature is extracted from the image forming apparatus with the handle 66 of the assist unit 40 being gripped. FIG. 15 shows when the heating roller 14 is about to be extracted in the direction as indicated by the arrow B. At this time, the guide shaft 30 is reliably held by the inner cylinder 59*b* of the housing 59, and the inner peripheral part of the absorber 14*d* slides on the outer peripheral surface of the guide shaft 30. Therefore, it is not necessary to manually hold a part of the heating roller 14 at high temperature, which enables the smooth and safe extraction of the heating roller 14. Even after the extraction of the heating roller 14, the centering member 47 and the holding member 49 remain as they are.

Next, in step 6, the assist unit 40 is attached to the new heating roller 14 for replacement, and the heating roller 14 is loaded by the use of the guide shaft 30. Note that the new heating roller 14 is not shown in the figures, but its basic configuration is the same.

Then, in step 7, the assist unit 40 is extracted from the heating roller 14. In step S8, the holding member 48 is attached by the use of the guide shaft 30. In step 9, the stopper 31 is disengaged to extract the guide shaft 30. In step 10, the lamp cartridge 63 covered with the protection member 64 is inserted in the heating roller 14, and then the holding member 48 is extracted from the heating roller 14, thereby completing the attachment of the lamp cartridge 63.

Note that the attachment of the new heating roller 14 in step 6 is the inverse operation of the extraction of the heating roller 14 in step 5, and the extraction of the assist unit 40 in step 7 is the inverse operation of the attachment of the assist unit 40 in step 4. At this time, the lever parts 41*c* of the latches 41 are rotated outward, which in turn causes the large-diameter parts 69 of the push pins 68 to be projected from the outer peripheral part of the unit main body 45*a* to press the end surface of the heating roller 14 through the rings 65. Therefore, the assist unit 40 can be easily and promptly separated from the heating roller 14. The attachment of the holding member 48 in step 8 is the inverse operation of the extraction of the holding member 48 in step 3; the extraction of the guide shaft 30 in step 9 is the inverse operation of the attachment of the guide shaft 30 in step 2; and the attachment of the lamp cartridge 63 in step 10 is the inverse operation of the extraction of the lamp cartridge 63 in step 1.

Furthermore, the structure near the heating roller 14, the attachment/attachment operation of the lamp cartridge 63, and the like are the same as those of the first embodiment.

According to the first and second embodiments, the guide shaft 30 is inserted in the image forming apparatus from the direction as indicated by the arrow B (backside of the image forming apparatus) as shown in FIG. 6. However, the guide shaft 30 may be inserted in the image forming apparatus from the direction as indicated by the arrow A (front side of the image forming apparatus) so as to be fixed.

According to the first and second embodiments, the heating roller 14 and the assist unit 40 are linked to each other by the use of the absorber 14*c* as shown in FIGS. 13 and 15. However, in order to link the heating roller 14 and the assist unit 40 to each other, linking parts (such as concave parts, convex parts, and holes) to be engaged with the assist unit 40 may be provided in the heating roller 14.

According to the first and second embodiments, the replacement of the heating roller 14 having the heat sources is described. However, the embodiments of the present invention can be applied to the replacement of a pressure roller having heat sources.

According to the first and second embodiments, the heating roller 14 is coated with a toner releasing agent and lubricant oil. However, the embodiments of the present invention can also be applied to the fixing unit (image forming apparatus) that coats the pressure roller 15 or both the heating roller 14 and the pressure roller 15 with a toner releasing agent and lubricant oil.

According to the second embodiment, the push pins 68 are used to separate the assist unit 40 from the heating roller 14. However, a separation unit having another configuration such as a rotation lever, whose point of action presses the end surface of the heating roller 14, may be used.

Third Embodiment

Next, a description is made of a third embodiment as another mode of the present invention.

As shown in FIGS. 20A through 20F, a support roller member 170 is mainly composed of a support roller 171; a first shaft 172 that rotatably supports the support roller 171; a roller plate 173 that fixes the first shaft 172 to one free end; a second shaft 174 provided at the base end of the roller plate 173; and a holder plate 175 that rotatably supports the second shaft 174.

As described below, the heating roller 14 at a high temperature of about 200° C. passes through above the support roller 171 when the heating roller 14 is replaced. Therefore, the support roller 171 is excellent in heat resistance and made of a material the same as or the same type as that of the front surface layer 14*b* so as not to damage the front surface layer 14*b* (see FIG. 4) of the heating roller 14. According to this embodiment, the front surface layer 14*b* of the heating roller 14 is made of a fluorine resin such as a PTFE (polytetrafluoroethylene) resin, a PFA (tetrafluoroethylene perfluoroalkyl vinyl ether copolymer) resin, or a FEP (tetrafluoroethylene hexafluoropropylene copolymer) resin. The support roller 171 is made of a material the same as or the same type (a fluorine resin in this embodiment) as these materials.

Furthermore, in order to prevent the support roller 171 from damaging the front surface of the heating roller 14 when the heating roller 14 passes through above the rotating support roller 171, the support roller 171 is formed into a drum shape such that the front surface of the heating roller 14 is brought into point-contact with the front surface of the support roller 171.

One side end of the roller plate 173 is folded to form a hook 176 in an integrated manner, and a groove part 177 is formed in the holder plate 175 for fitting with (engagement with) the hook 176. The width of the groove part 177 is approximately the same in size as the plate thickness of the hook 176. Furthermore, an elongated hole 178, which extends parallel to the groove part 177 and in which the second shaft 174 is inserted, is formed in the holder plate 175. As described below, the roller plate 173 is supported in a manner capable of being vertically moved.

Figure 20A:
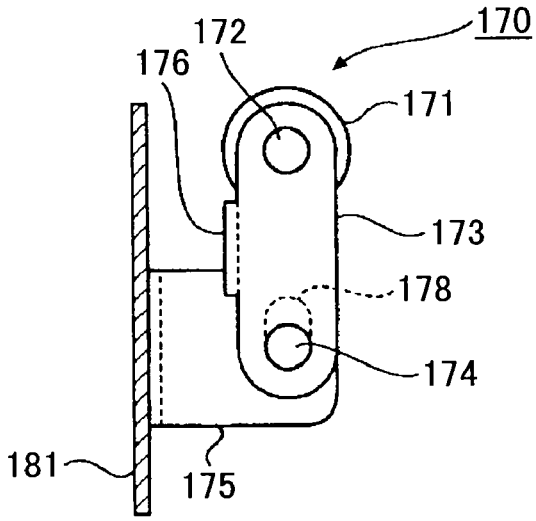
Figure 20B:
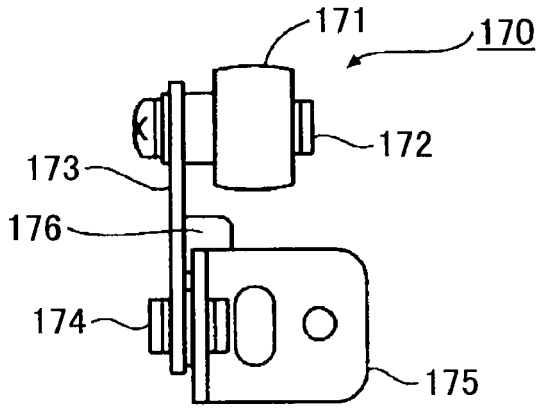

FIGS. 20A and 20B are diagrams showing the support roller member 170 when the heating roller 14 is extracted from or inserted in the image forming apparatus. FIG. 20A is a side view of the support roller member 170, and the FIG. 20B is an end plan view. As shown in FIG. 20A, when the hook 176 provided in the roller plate 173 is inserted in (locked by) the groove part 177 formed in the holder plate 175, the roller plate 173 is maintained upright. Accordingly, as shown in FIG. 8, the support roller 171 faces an opening part 78 of the frame 50 for replacement purposes.

Figure 20C:
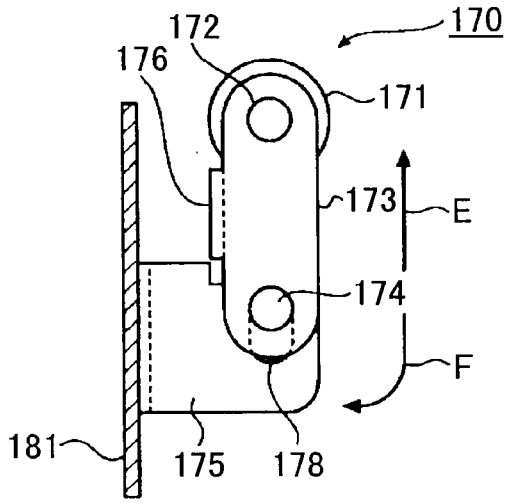
Figure 20D:
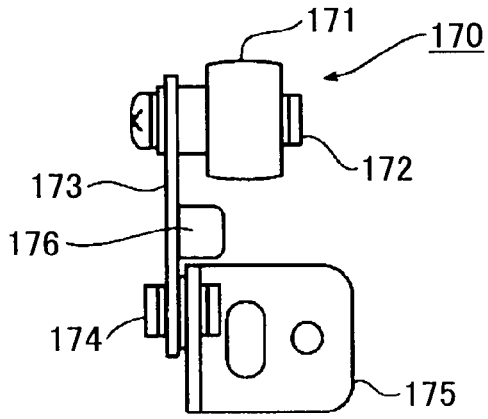

FIGS. 20C and 20D are diagrams showing when the support roller member 170 is being moved from the operating position described above to a standby position described below. FIG. 200 is a side view of the support roller member 170, and the FIG. 20D is an end plan view. As shown in FIG. 20C, the roller plate 173 is lifted up in the direction as indicated by the arrow E to disengage (unlock) the hook 176 from the groove part 177. Then, the roller plate 173 is rotated 180 degrees about the center of the second shaft 174 in the direction as indicated by the arrow F.

Figure 20E:
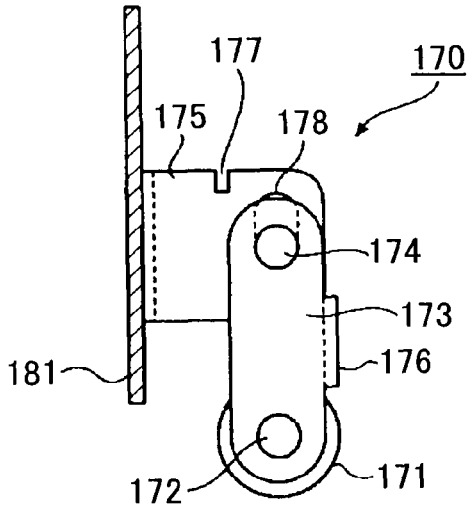
Figure 20F:
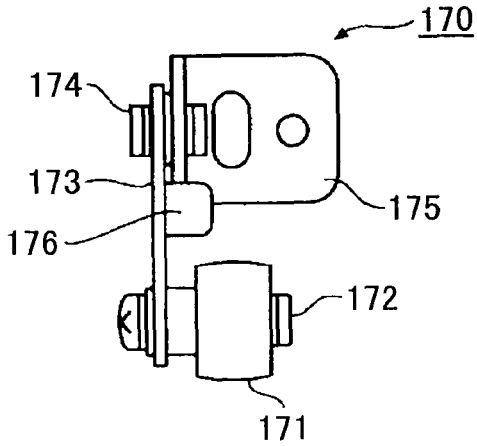

FIGS. 20E and 20F are diagrams showing when the support roller member 170 is on standby. FIG. 20E is a side view of the support roller member 170 and FIG. 20F is an end plan view where the roller plate 173 is suspended from the second shaft 174. Accordingly, the support roller 171 is on standby at a lower position away from the opening 78 of the frame 50 (see FIG. 6) for replacement purposes.

Figure 21:
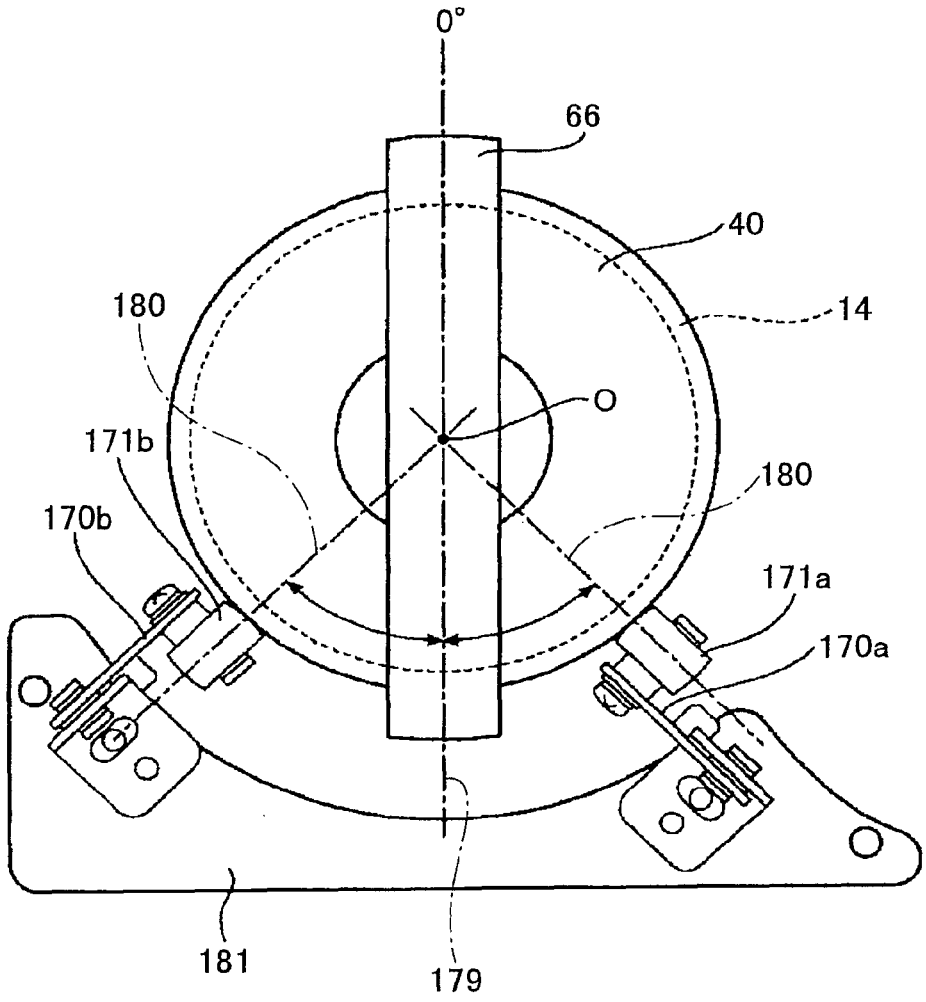
FIG. 21 is a view showing the arrangement of two assist roller members with respect to the assist unit.

FIG. 21 is a diagram showing the arrangement of the support roller members 170 with respect to the assist unit 40. According to this embodiment, two assist roller members 170*a* and 170*b* are used. As shown in, for example, FIG. 8, the two assist roller members 170*a* and 170*b* are provided on the outer side surface of the frame 50 and near the opening part 78 of the frame 50 for replacement purposes such that the heating roller 14 can be smoothly extracted with the handle 66 of the assist unit 40 being gripped by hand.

Specifically, the two support roller members 170*a* and 170*b* are provided below the heating roller 14. Moreover, as shown in FIG. 21, assuming that the position of a vertical line 179 passing through the roller center O of the heating roller 14 is defined as 0°, center lines 180 orthogonal to the roller shafts of the support rollers 171*a* and 171*b* are set so as to cross the vertical line 179 at angles in the range from ±30° to ±60°, preferably in the range from ±40° to ±50° (45° in this embodiment). The support roller members 170*a* and 170*b* are arranged symmetrically about the vertical line 179. With this arrangement, the support roller members 170*a* and 170*b* stably support the heating roller 14 without interfering with the operation when the heating roller 14 is extracted by the assist unit 40. Therefore, unstable factors that could occur at the extraction of the heating roller 14 can be eliminated.

Reference numeral 181 in FIG. 21 denotes an attachment plate on which the support roller members 170*a* and 170*b* are provided symmetrically. The support roller members 170*a* and 170*b* are fixed outside the frame 50 through the attachment plate 181.

According to this embodiment, the two support roller members 170 are provided below the heating roller 14. However, about one or two support roller members 170 may also be provided above the heating roller 14. In this case, it is necessary to set the upper support rollers 170 at positions so as not to interfere with the extraction of the heating roller 14 by the assist unit 40 in the same manner as the lower support roller members 170*a* and 170*b*. Note that a predetermined amount of gap is required between the upper support roller members 170 and the heating roller 14 so as not to increase a binding force with respect to the heating roller 14.

(Procedure for Replacing Heating Roller)

Next, a description is made of a procedure for replacing the heating roller 14. The heating roller 14 is replaced when it comes to the end of its service life or replaced so as to meet the demands of an image forming apparatus as described above.

Figure 22:
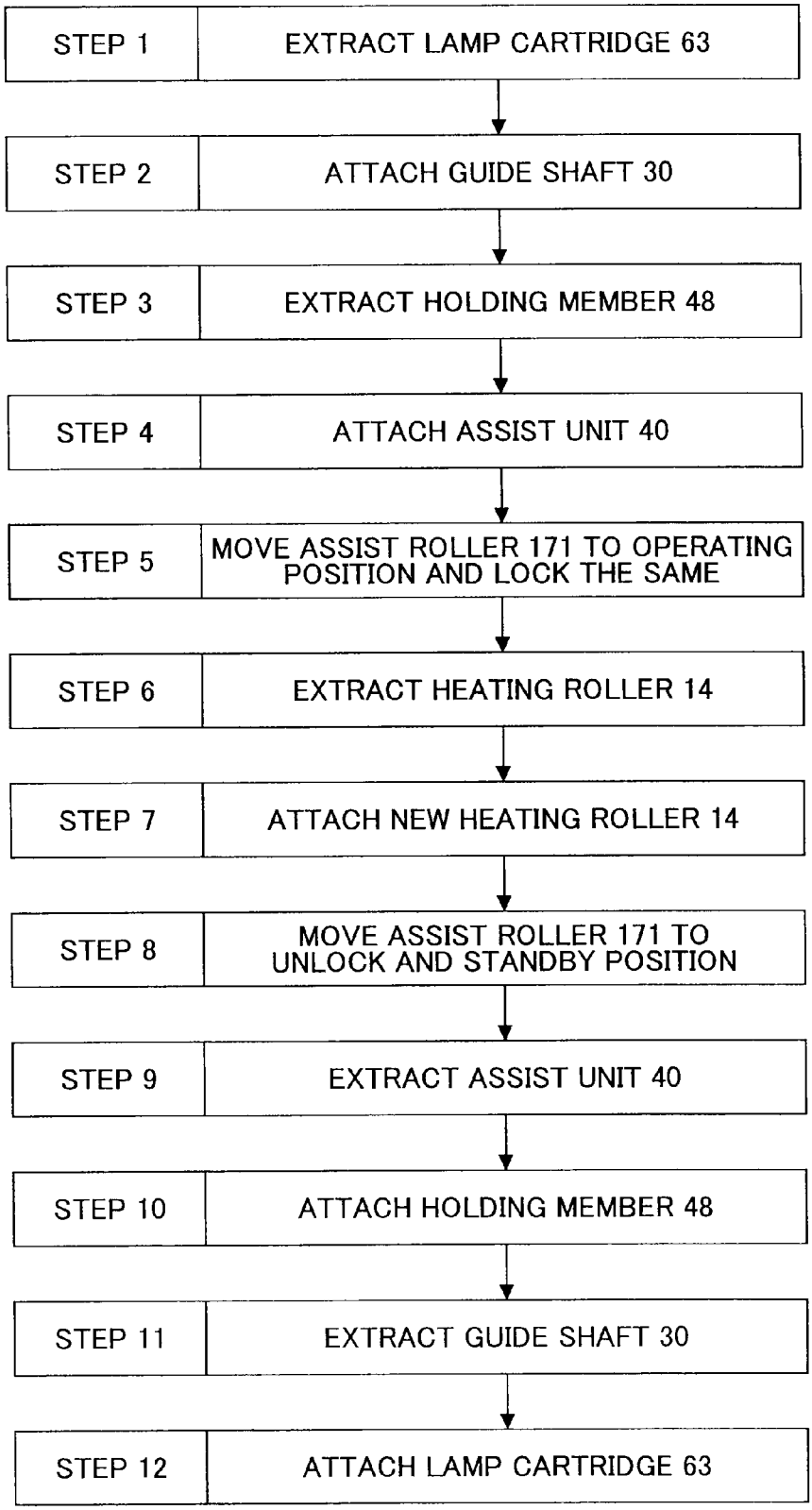
FIG. 22 is a step diagram showing a procedure for replacing the heating roller according to the third embodiment of the present invention.

FIG. 22 is a step diagram showing the procedure for replacing the heating roller 14. As shown in FIG. 22, in step 1, the lamp cartridge 63 is extracted from the inside of the heating roller 14 by the use of the protection member 64. Since this operation is described above with reference to FIG. 5, its duplicated descriptions are omitted here. The extracted lamp cartridge 63 is covered with the rigid protection member 64. Therefore, the lamp cartridge 63 is not carelessly damaged during its replacement operation.

Next, in step 2, as shown in FIG. 6, the guide shaft 30 is inserted in the direction as indicated by the arrow B from the through-hole 59*a* of the housing 59. The guide shaft 30 is guided and held by the inner cylinder 59*b* of the housing 59, the absorber 14*d*, and the holding member 48. When the insertion of the guide shaft 30 reaches a predetermined position, the stopper 31 is inserted in the slit 30*a* of the guide shaft 30, thereby completing the attachment of the guide shaft 30.

Then, in step 3, the wing screws 54 are loosened to extract the holding member 48 holding the centering member 46, the bearing 51, the springs 52, the stopper plate 53, and the like in the direction as indicated by the arrow B. At this time, the tip end part of the guide shaft 30 is slightly projected outward from the outer side surface of the frame 50. Therefore, along with the guidance of the guide shaft 30, the holding member 48 can be smoothly extracted without colliding against the opening end of the frame 50. Note that since the centering member 46 is separated from the heating roller 14 while the holding member 48 is being extracted, the centering member 46 and the bearing 51 are brought into contact with the stopper plate 53 by the restoration force of the springs 52.

At this time, since the support roller 171 of the support roller member 170 is on standby (placed at a lower position) as shown in FIG. 6, there occurs no problem in extracting the holding member 48.

Next, in step 4, with the handle 66 being gripped, the assist unit 40 is inserted from the side of the tip end part of the guide shaft 30 having the inclination surface 30*b*. At this time, the lever parts 41 of the latches 41 are mutually directed outward as shown in FIG. 9A. Accordingly, the interval between the inner side surface 45*a* of the unit main body 45 and the holding pieces 43*a* of the holder 43 becomes large as indicated by L1.

FIGS. 12A and 12B are the diagrams showing the relationship between the absorber 14*c* and the holding pieces 43*a* of the holder 43 as seen from the direction of the arrows X and X in FIG. 7. FIG. 12A is the diagram showing when the assist unit 40 is inserted in the heating roller 14, and FIG. 12B is the diagram showing when the assist unit 40 is attached to the absorber 14*c*.

As shown in FIG. 12A, at the inner peripheral part of the absorber 14*c*, the two cutouts 67 in which the holding pieces 43*a* of the holder 43 can be inserted are formed so as to be opposite to each other. As shown in FIG. 7, when the assist unit 40 is inserted in the heating roller 14, the holding pieces 43*a* of the holder 43 pass through the cutouts 67 and are placed on the left side of the absorber 14*c* in FIG. 7. When the flange 45*c* of the unit main body 45 is brought into contact with the outer side surface of the frame 50, the insertion of the assist unit 40 is stopped.

When the assist unit 40 is rotated by a predetermined angle with the handle 66 being gripped, the holding pieces 43*a* of the holder 43 are disengaged from the cutouts 67 and face the other inner peripheral part of the holder 43 as shown in FIG. 12B. When the lever parts 41*c* of the latches 41 are mutually rotated inward as shown in FIG. 13, the holding pieces 43*a* of the holder 43 are drawn to the side of the unit main body 45 through the shafts 42, which in turn elastically holds the inner peripheral part of the holder 43 between the holding pieces 43*a* of the holder 43 and the inner side surface 45*a* of the unit main body 45. Thus, the assist unit 40 is attached to the heating roller 14 through the absorber 14*c*.

Next, in step 5, the assist roller 171 is moved to its operating position and locked. In order to perform this operation, the roller plate 173 shown in FIG. 20E is rotated by 180 degrees in the direction opposite to the arrow F, and hook 176 is fitted in the groove part 177. With this movement, the support roller 171 faces the opening part 78 of the frame 50 as shown in FIG. 8 for replacement purposes.

Figure 23:
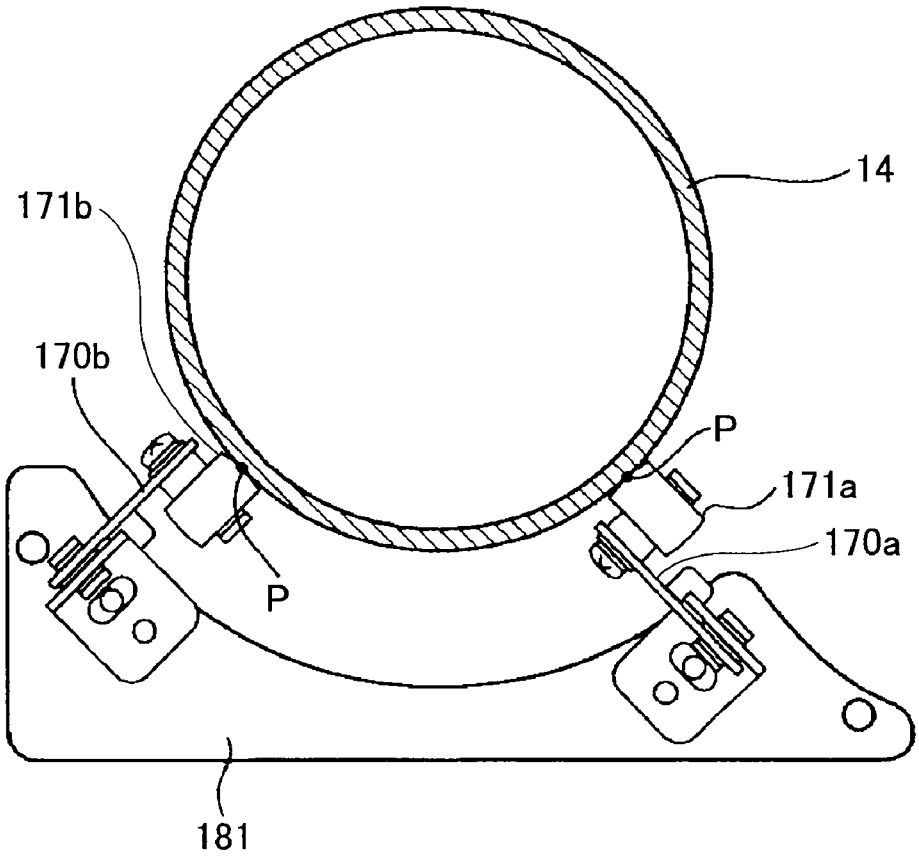
FIG. 23 is a partial cross-sectional view where the heating roller is supported by the two support roller members according to the embodiments of the present invention.

Then, in step 6, the heating roller 14 at high temperature is extracted from the image forming apparatus with the handle 66 of the assist unit 40 being gripped. At this time, the guide shaft 30 is reliably held by the inner cylinder 59*b* of the housing 59, the inner peripheral part of the absorber 14*d* slides on the outer peripheral surface of the guide shaft 30, and a part of the heating roller 14 projected from the frame 50 is stably supported by the support rollers 171*a* and 171*b*. Along with the extraction of the heating roller 14, the support rollers 171*a* and 171*b* are rotated. FIG. 23 shows the heating roller 14 in a supported state. As shown in FIG. 23, the heating roller 14 is supported by the support rollers 171*a* and 171*b* at two contact points P. Therefore, it is not necessary to manually hold a part of the heating roller 14 at high temperature, which enables the smooth and safe extraction of the heating roller 14.

Even after the extraction of the heating roller 14, the centering member 47 and the holding member 49 remain as they are. FIG. 14 shows the heating roller 14 being extracted.

Next, in step 7, the assist unit 40 is attached to the new heating roller 14 for replacement (not shown), and the heating roller 14 is loaded by the use of the guide shaft 30. At this time, the support rollers 171*a* and 171*b* are used to enable the smooth insertion of the heating roller 14.

Then, in step 8, the support rollers 171*a* and 171*b* are unlocked and moved to their standby positions. This operation is described above with reference to FIGS. 20A through 20F, so that its duplicated descriptions are omitted here.

Next, in step 9, the assist unit 40 is extracted from the heating roller 14. In step S10, the holding member 48 is attached by the use of the guide shaft 30. In step 11, the stopper 31 is disengaged to extract the guide shaft 30. In step 12, the lamp cartridge 63 covered with the protection member 64 is inserted in the heating roller 14, and then the holding member 48 is extracted from the heating roller 14, thereby completing the attachment of the lamp cartridge 63.

Note that since the attachment of the new heating roller 14 in step 7 is the inverse operation of the extraction of the heating roller 14 in step 6; the extraction of the assist unit 40 in step 9 is the inverse operation of the attachment of the assist unit 40 in step 4; the attachment of the holding member 48 in step 10 is the inverse operation of the extraction of the holding member 48 in step 3; the extraction of the guide shaft 30 in step 11 is the inverse operation of the attachment of the guide shaft 30 in step 2; and the attachment of the lamp cartridge 63 in step 12 is the inverse operation of the extraction of the lamp cartridge 63 in step 1, their descriptions are omitted here.

According to the third embodiment, when the heating roller 14 is replaced, the heating roller 14 and the assist unit 40 are linked to each other by the use of the absorber 14*c* as shown in FIG. 13. However, in order to link the heating roller 14 and the assist unit 40 to each other, linking parts (such as concave parts, convex parts, and holes) to be engaged with the assist unit 40 may be provided in the heating roller 14.

According to the third embodiment, the support rollers are used as the support members. However, other support members, such as those having a ball that can be rotated in, for example, one direction and those having a non-rotating arc-like projection, may be used.

According to the third embodiment, the entire support rollers are made of a fluorine resin. However, the support rollers, balls, or main bodies of projections may be made of a material having rigidity such as metal and coated with a fluorine resin at their front surface layers.

According to the third embodiment, the replacement of the heating roller 14 is described. However, this embodiment of the present invention can be applied to the replacement of the pressure roller 15 with or without heat sources.

According to the third embodiment, the heating roller 14 is coated with a toner releasing agent and lubricant oil. However, this embodiment of the present invention can also be applied to the fixing unit (image forming apparatus) that coats the pressure roller 15 or both the heating roller 14 and the pressure roller 15 with a toner releasing agent and lubricant oil.

Next, a description is made of the effects of the embodiments of the present invention. According to the embodiments of the present invention, the assist-unit linkage part, to which the assist unit assisting the extraction of the heating roller is detachably linked, is provided at the tip end part in the extracting direction of the roller, and the assist unit for extracting the heating roller can be separated from the fixing unit. Therefore, the fixing unit can be downsized more than the one described in Patent Document 1. Furthermore, the assist unit is separated from the fixing unit at a normal printing operation. Therefore, the assist unit is not heated to high temperature due to the heat of the fixing unit, which in turn can improve the workability and the safeness when the roller is replaced.

According to the embodiments of the present invention, the heat transfer preventing members integrally linked to the heating roller are used as the assist-unit linkage part. Therefore, it is not necessary to provide the roller with a dedicated assist-unit linkage part, which in turn addresses the problem of complicating the structure of the fixing unit and increasing its size.

According to the embodiments of the present invention, the inner cylinder that holds the guide shaft is provided inside the bearing holding member. Therefore, the guide shaft is reliably held by the inner cylinder when the roller is replaced, which in turn enables the safe and smooth replacement of the heating roller.

According to the embodiments of the present invention, the locking units are provided so as to prevent a positional shift of the guide shaft. Therefore, the functions of the guide shaft are reliably performed, which in turn enables the safe and smooth replacement of the heating roller.

According to the embodiments of the present invention, the guide shaft is held by the heat transfer preventing members. Therefore, the posture of the guide shaft is stabilized, which in turn enables the safe and smooth replacement of the heating roller.

According to the embodiments of the present invention, the auxiliary tool for replacing the roller has the guide shaft detachably attached to the fixing unit and the assist unit that is externally fit in the end of the guide shaft to insert and extract the heating roller, and the guide shaft and the assist unit can be separated from the fixing unit. Therefore, the fixing unit can be downsized more than the one described in Patent Document 1. The guide shaft and assist unit are separated from the fixing unit at a normal printing operation. Therefore, the guide shaft and the assist unit are not heated to high temperature due to the heat of the fixing unit, which in turn enables the simple and safe replacement of the heating roller.

According to the embodiments of the present invention, even the roller, which is at high temperature due to its heat sources, is simply and safely replaced.

According to the embodiments of the present invention, even the roller, which is hard to be handled due to its coated toner releasing agent or lubricant oil, is simply and safely replaced.

According to the embodiments of the present invention, the assist unit has the holding unit that holds the assist-unit linkage part of the heating roller and the operations unit that performs the holding operation of the holding unit. Therefore, the assist unit is reliably linked to the roller.

According to the embodiments of the present invention, the assist unit has the separation units that press the end surface of the roller to separate the assist unit from the heating roller. Therefore, the assist unit is promptly and reliably separated from the heating roller, which in turn enables the quick replacement operation of the roller.

According to the embodiments of the present invention, the plural separation units are arranged at the outer peripheral part of the assist unit at even intervals. Therefore, the assist unit is separated from the heating roller in an entirely well-balanced manner.

According to the embodiments of the present invention, each of the separation units has the push pin supported by the assist unit in a manner capable of being moved in the shaft direction of the roller. When the ends of the push pins projected from the assist unit are pressed, the push pins press the end surface of the heating roller to separate the assist unit from the heating roller. Therefore, the configuration of the separation units is simple, and the structure of the assist unit does not become complicated.

According to the embodiments of the present invention, the operations unit, which performs the holding operation of the holding unit for holding the assist-unit linkage part of the roller, presses the push pins. Therefore, when the holding of the assist-unit linkage part by the holding unit is cancelled, the assist unit is also separated from the roller by the push pins. Furthermore, the guide shaft and the assist unit are used in combination, which in turn enables the smooth and safe replacement operation of the heating roller.

According to the embodiments of the present invention, the protection member is used. Therefore, the collective replacement of the lamps is smoothly performed, and damage to the lamps caused during the replacement of the lamps can be avoided. As a result, high safeness is obtained.

According to the embodiments of the present invention, the protection member is made of a paper cylinder. Therefore, the protection member is easily obtained, and costs of the protection member can be reduced.

According to the embodiments of the present invention, the assist unit can be promptly and reliably separated from the heating roller by the separation units. Therefore, the replacement operation of the roller can become more efficient.

The present invention is not limited to the specifically disclosed embodiments, and variations and modifications may be made without departing from the scope of the present invention.

The present application is based on Japanese Priority Applications No. 2009-002811 filed on Jan. 8, 2009, No. 2009-086308 filed on Mar. 31, 2009, and No. 2009-202663 filed on Sep. 2, 2009, the entire contents of which are hereby incorporated herein by reference.

What is claimed is:

1. A fixing unit comprising:

a heating roller;

a pressure roller capable of being brought into press-contact with the heating roller, one of the heating roller and the pressure roller being a roller to be replaced, and the roller to be replaced being configured to be extracted along a shaft direction thereof; and an assist-unit linkage part to which an assist unit, for assisting an extraction of the roller to be replaced, is detachably linked, the assist-unit linkage part being provided at a tip end part in an extracting direction of the roller to be replaced, wherein the assist-unit linkage part includes a heat transfer preventing member provided inside an area near one opening end of the roller to be replaced, the heat transfer preventing member being integrated with the roller to be replaced, and wherein the assist unit is attached to the roller to be replaced through the heat transfer preventing member.

2. The fixing unit according to claim 1, wherein the roller to be replaced incorporates a heat source.

3. The fixing unit according to claim 1, wherein the roller to be replaced is coated with a toner releasing agent or a lubricant oil.

4. The fixing unit according to claim 1, further comprising:

a bearing;

a bearing holding member that holds the bearing, the bearing and the bearing holding member being provided near an end part on a side opposite to another end part having the assist-unit linkage part of the roller to be replaced; and an inner cylinder that is provided inside the bearing holding member and holds a guide shaft, the guide shaft being inserted from an inside of the bearing holding member to an inside of the roller to be replaced so as to guide an insertion and an extraction of the roller to be replaced.

5. The fixing unit according to claim 1, further comprising:

a locking unit that prevents a positional shift of a guide shaft, the guide shaft being inserted in an inside of the roller to be replaced so as to guide an insertion and an extraction of the roller to be replaced.

6. The fixing unit according to claim 1, further comprising:

a heat transfer preventing member provided inside an area near an opening end on a side opposite to an end part having the assist-unit linkage part of the roller to be replaced, wherein an inner diameter of the heat transfer preventing member is approximately the same in size as an outer diameter of a guide shaft, the guide shaft being inserted in an inside of the roller to be replaced so as to guide an insertion and an extraction of the roller to be replaced.

7. An image forming apparatus comprising:

a transfer unit that transfers a toner image on an image carrier onto a medium; and the fixing unit according to claim 1;

wherein the fixing unit has the heating roller and the pressure roller capable of being brought into press-contact with the heating roller, and causes the medium having the toner image transferred thereon to pass through a gap between the heating roller and the pressure roller to fix the toner image onto the medium.

8. A fixing unit comprising:

a heating roller;

a pressure roller capable of being brought into press-contact with the heating roller, one of the heating roller and the pressure roller being a roller to be replaced, and the roller to be replaced being configured to be inserted and extracted along a shaft direction thereof;

an opening for replacement formed in a frame opposite to the roller to be replaced;

a support member provided outside the frame and near the opening for replacement so as to support the roller to be replaced; and a rotatable rotator provided at least at a part of the support member that contacts the roller to be replaced.

9. The fixing unit according to claim 8, wherein at least a front surface part of the support member that contacts the roller to be replaced is made of a material having a slipping property.

10. The fixing unit according to claim 9, wherein the roller to be replaced has a front surface layer made of a fluorine resin, and the part of the support member that contacts the roller to be replaced is made of the fluorine resin.

11. The fixing unit according to claim 8, wherein the roller to be replaced is supported by a point contact with the support member.

12. The fixing unit according to claim 8, wherein the support member is capable of reciprocating between an operating position where the roller to be replaced is supported and a standby position away from the operating position, and wherein the fixing unit further comprises a locking unit that maintains the support member at the operating position.

13. The fixing unit according to claim 8, wherein, when a position on a vertical line passing through a roller center of the roller to be replaced is defined as 0°, at least two support members are provided in a range from ±30° to ±60° so as to support a lower part of the roller to be replaced.

14. The fixing unit according to claim 13, wherein the at least two support members are provided symmetrically about a center of the vertical line.

15. The fixing unit according to claim 13, wherein one of the support members is also provided at an upper part of the roller to be replaced to be inserted and extracted in such a manner as to have a gap between the upper part of the roller to be replaced and the support member.

16. A roller replacement auxiliary tool of a fixing unit that extracts and replaces a roller to be replaced including one of a heating roller and a pressure roller, which is capable of being brought into press-contact with the heating roller, along a shaft direction of the roller to be replaced, the roller replacement auxiliary tool comprising:

a guide shaft detachably connected to the fixing unit so as to penetrate an opening formed by penetration in the shaft direction of the roller to be replaced;

a locking unit including an insertion member that is accommodated in an opening through a wall of the guide shaft when the guide shaft is in a predetermined position; and an assist unit that is detachably connected to an assist-unit linkage part provided at a tip end part in an extracting direction of the roller to be replaced and is externally fit in an end part of the guide shaft to insert and extract the roller to be replaced.

17. The roller replacement auxiliary tool of the fixing unit according to claim 16, wherein the roller to be replaced incorporates a heat source.

18. The roller replacement auxiliary tool of the fixing unit according to claim 16, wherein the roller to be replaced is coated with a toner releasing agent or a lubricant oil.

19. A roller replacement auxiliary tool of a fixing unit that extracts and replaces a roller to be replaced including one of a heating roller and a pressure roller, which is capable of being brought into press-contact with the heating roller, along a shaft direction of the roller to be replaced, the roller replacement auxiliary tool comprising:

a guide shaft detachably connected to the fixing unit so as to penetrate an opening formed by penetration in the shaft direction of the roller to be replaced; and an assist unit that is detachably connected to an assist-unit linkage part provided at a tip end part in an extracting direction of the roller to be replaced and is externally fit in an end part of the guide shaft to insert and extract the roller to be replaced, wherein the fixing unit includes a support member provided outside a frame in which the opening is formed and near the opening so as to support the roller to be replaced; and a rotatable rotator provided at least at a part of the support member that contacts the roller to be replaced.

20. The roller replacement auxiliary tool of the fixing unit according to claim 19, wherein the roller to be replaced incorporates a heat source.

21. The roller replacement auxiliary tool of the fixing unit according to claim 19, wherein the roller to be replaced is coated with a toner releasing agent or a lubricant oil.

* * * * *